US010571142B2

(12) United States Patent
Buda et al.

(10) Patent No.: US 10,571,142 B2
(45) Date of Patent: Feb. 25, 2020

(54) INTERIOR USER-COMFORT ENERGY EFFICIENCY MODELING AND CONTROL SYSTEMS AND APPARATUSES USING COMFORT MAPS

(71) Applicant: SCHNEIDER ELECTRIC USA, INC., Andover, MA (US)

(72) Inventors: Paul Robert Buda, Raleigh, NC (US); Larry A. Turner, Cary, NC (US); Scott Robert Brown, Wake Forest, NC (US); Gary Brent Pollard, Wendell, NC (US); David R. Glasgow, Wendell, NC (US); Jason Pazis, Cambridge, MA (US)

(73) Assignee: Schneider Electric USA, Inc., Andover, MA (US)

( * ) Notice: Subject to any disclaimer, the term of this patent is extended or adjusted under 35 U.S.C. 154(b) by 346 days.

(21) Appl. No.: 14/956,227

(22) Filed: Dec. 1, 2015

(65) Prior Publication Data

US 2016/0223217 A1 Aug. 4, 2016

Related U.S. Application Data

(60) Provisional application No. 62/110,344, filed on Jan. 30, 2015, provisional application No. 62/110,393, (Continued)

(51) Int. Cl.
*F24F 11/00* (2018.01)
*F24F 11/30* (2018.01)
(Continued)

(52) U.S. Cl.
CPC ..... *F24F 11/30* (2018.01); *F24F 11/62* (2018.01); *F24F 11/46* (2018.01)

(58) Field of Classification Search
None
See application file for complete search history.

(56) References Cited

U.S. PATENT DOCUMENTS 4,475,685 A 10/1984 Grimado
5,115,967 A 5/1992 Wedekind
(Continued)

FOREIGN PATENT DOCUMENTS

WO 02/054165 A2 7/2002

OTHER PUBLICATIONS

International Search Report for International Patent Application No. PCT/US2016/015748 dated May 23, 2016.
(Continued)

*Primary Examiner* — Bernard G Lindsay
(74) *Attorney, Agent, or Firm* — Locke Lord LLP

(57) ABSTRACT

The INTERIOR USER-COMFORT ENERGY EFFICIENCY MODELING AND CONTROL SYSTEMS AND APPARATUSES ("IUCEEMC") transforms comfort maps and occupant comfort inputs via a profile library manager component, exploration manager component, comfort map manager component, regulation monitor component, control temperature sequence generator component, and comfort map modification component, into comfort map and control temperature sequence outputs. In some implementations, the IUCEEMC can divide a timespace of a temperature model into a plurality of sections, select a section from the plurality of sections, perform a first persistent change of the section from the plurality of sections, and, via a control temperature sequence generator, calculate a control temperature sequence using the temperature model. The IUCEEMC can develop and execute a temperature trajectory on an HVAC system, such as a home or industrial HVAC system.

21 Claims, 17 Drawing Sheets

Related U.S. Application Data filed on Jan. 30, 2015, provisional application No. 62/110,386, filed on Jan. 30, 2015, provisional application No. 62/110,398, filed on Jan. 30, 2015, provisional application No. 62/110,379, filed on Jan. 30, 2015.

(51) Int. Cl.
*F24F 11/62* (2018.01)
*F24F 11/46* (2018.01)

(56) References Cited

U.S. PATENT DOCUMENTS

| | | | | |
|---|---|---|---|---|
| 6,478,233 | B1 | 11/2002 | Shah | |
| 7,130,719 | B2 | 10/2006 | Ehlers | |
| 8,352,082 | B2 | 1/2013 | Parker et al. | |
| 8,584,030 | B2 | 11/2013 | Laycook et al. | |
| 2003/0217143 | A1 | 11/2003 | Dudley | |
| 2004/0262409 | A1 | 12/2004 | Crippen | |
| 2007/0191987 | A1 | 8/2007 | Dang et al. | |
| 2009/0065596 | A1 | 3/2009 | Seem et al. | |
| 2010/0262298 | A1 | 10/2010 | Johnson et al. | |
| 2011/0083094 | A1 | 4/2011 | Laycock et al. | |
| 2011/0160913 | A1* | 6/2011 | Parker | F24D 19/1048 700/276 |
| 2012/0259469 | A1 | 10/2012 | Ward et al. | |
| 2013/0085614 | A1* | 4/2013 | Wenzel | G05D 23/1923 700/277 |
| 2013/0085616 | A1 | 4/2013 | Wenzel | |
| 2014/0222221 | A1* | 8/2014 | Boll | F24F 11/0086 700/278 |
| 2014/0277765 | A1 | 9/2014 | Karimi et al. | |
| 2014/0358291 | A1 | 12/2014 | Wells | |
| 2015/0134124 | A1* | 5/2015 | Carter | G05D 23/1923 700/278 |

OTHER PUBLICATIONS

Written Opinion for International Patent Application No. PCT/US2016/015748 dated May 23, 2016.

Karer G. et al: "Predictive Control of Temperature in a Batch Reactor with Discrete Inputs," Intelligent Control, 2005. Proceedings of the 2005 IEEE International Symposium on, Mediterrean Conference on Control and Automation Limassol, Cyprus Jun. 27-29, 2005, Piscataway, NJ, USA, IEEE, Jun. 27, 2005 (Jun. 27, 2005), pp. 855-860, XP010817135. The entire document.

European Search Report for EP 16153477 dated Nov. 15, 2016.

European Search Opinion for EP 16153477 dated Nov. 15, 2016.

International Search Report for PCT/US2016/015745 dated Mar. 31, 2016.

Written Opinion for PCT/US2016/015745 dated Mar. 31, 2016.

* cited by examiner

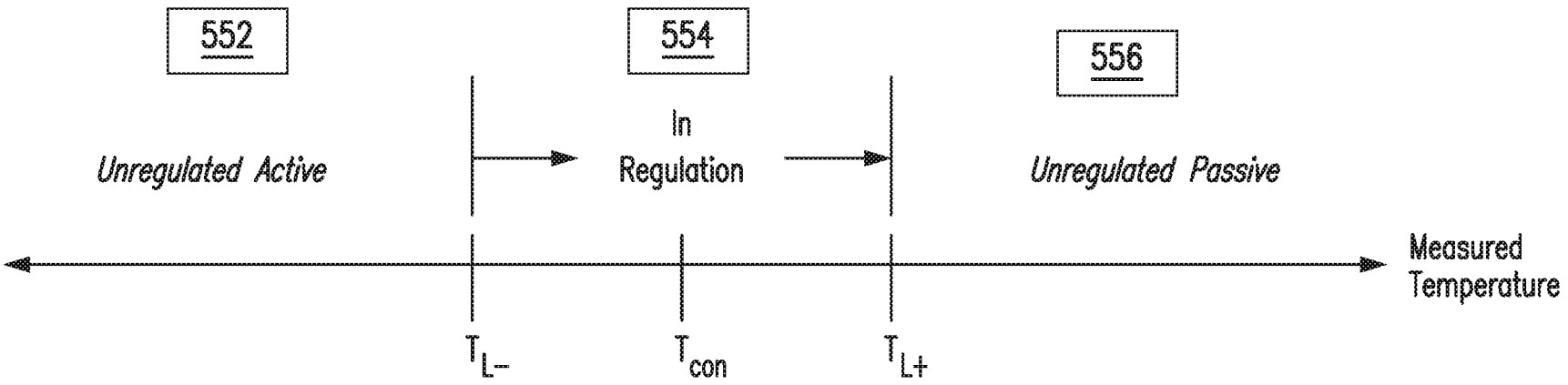
Heating Comfort Mode
FIG. 5B1
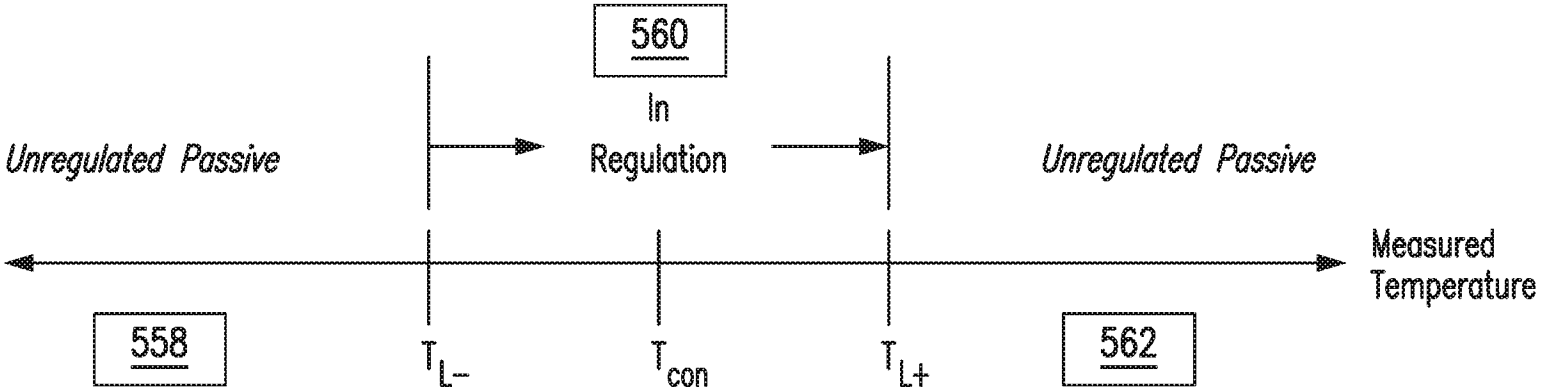
Cooling Comfort Mode
FIG. 5B2

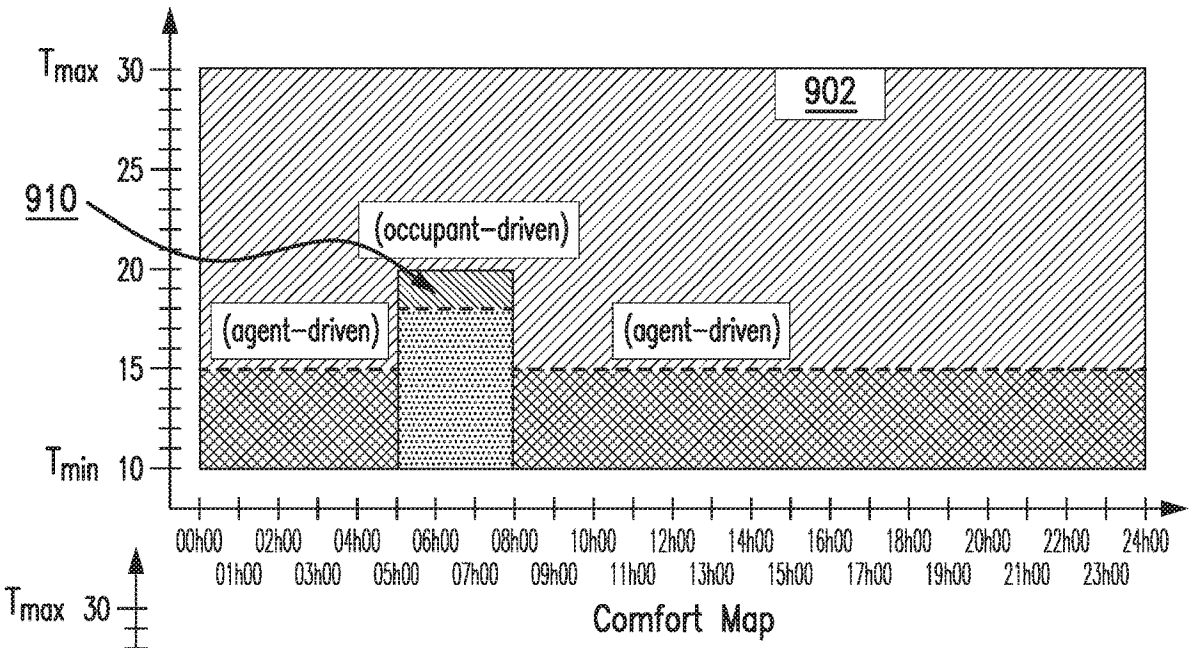
FIG. 9A1
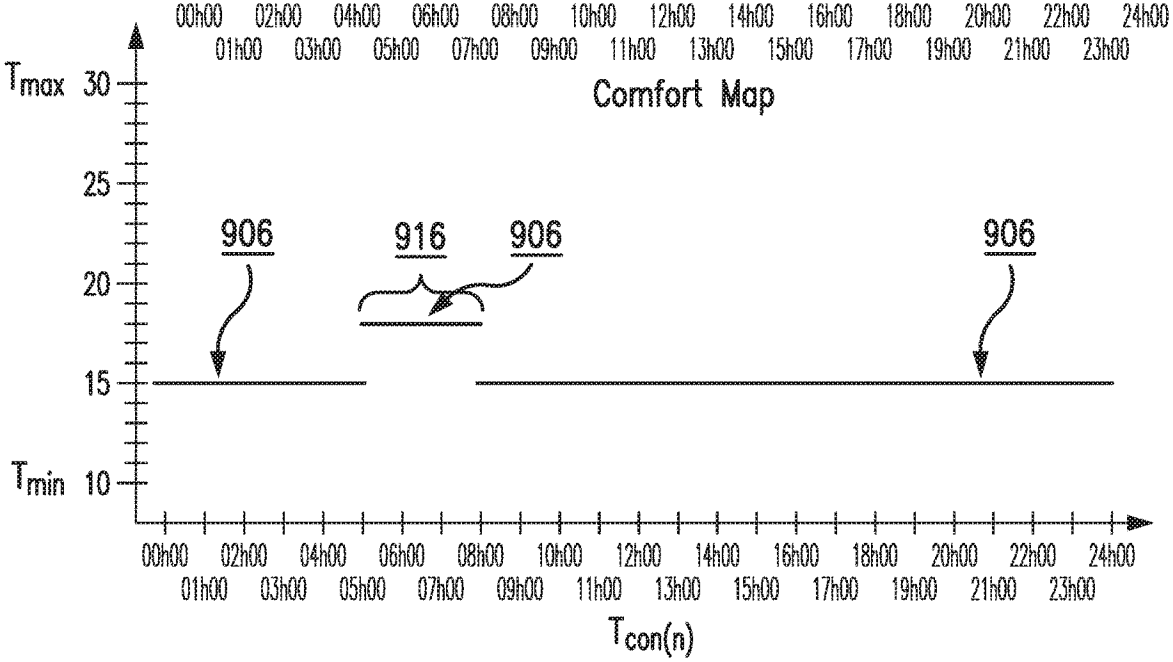
FIG. 9A2

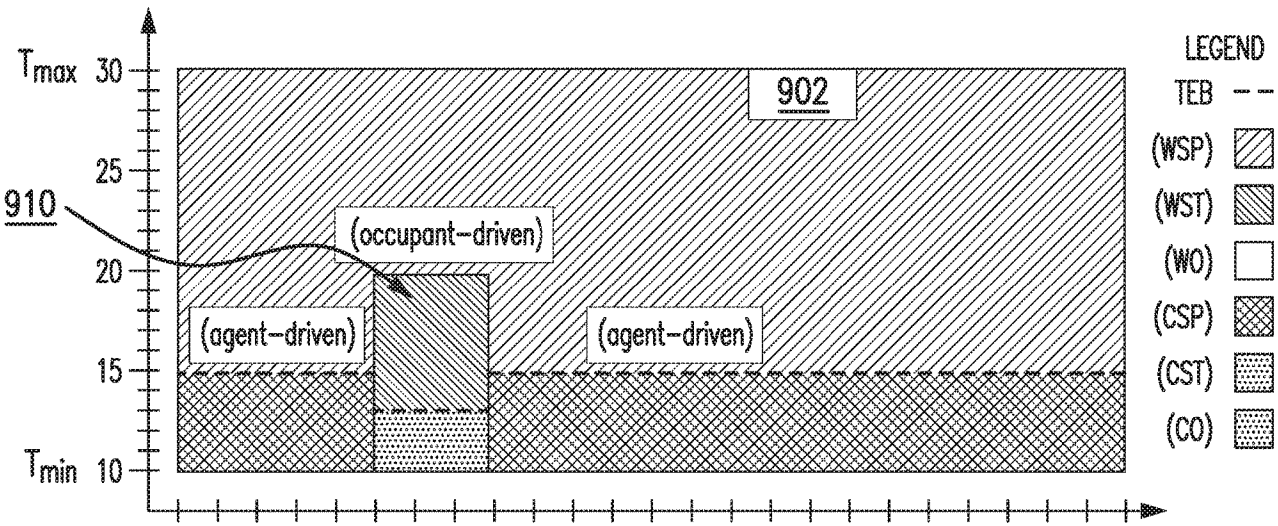
FIG. 9B1
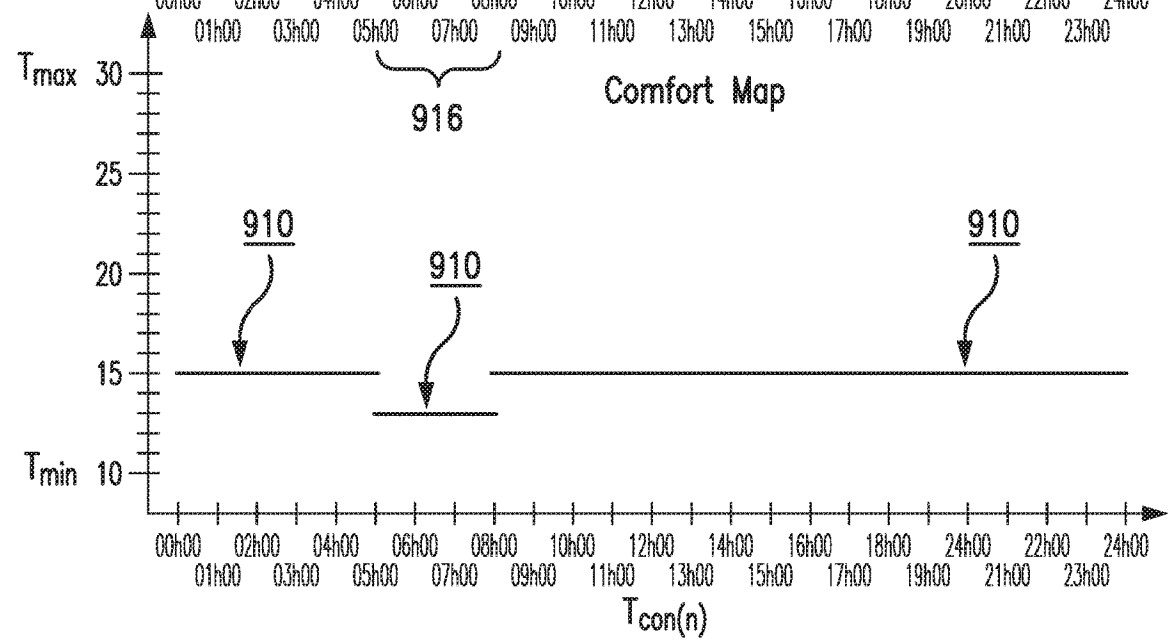
FIG. 9B2

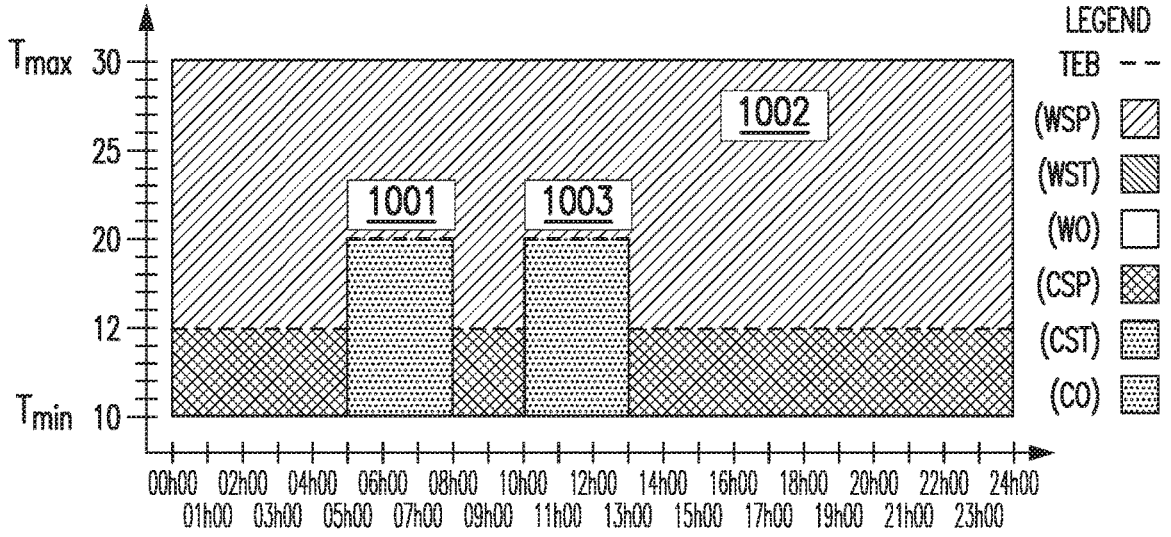
Comfort Map
FIG. 10A1
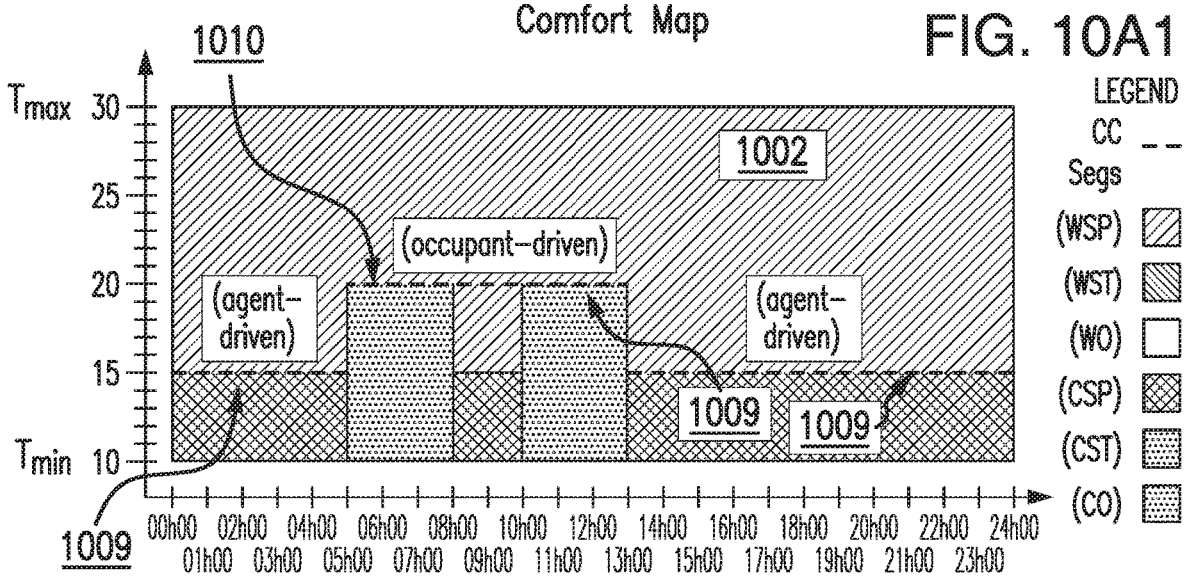
Cover Classifier Output
FIG. 10A2
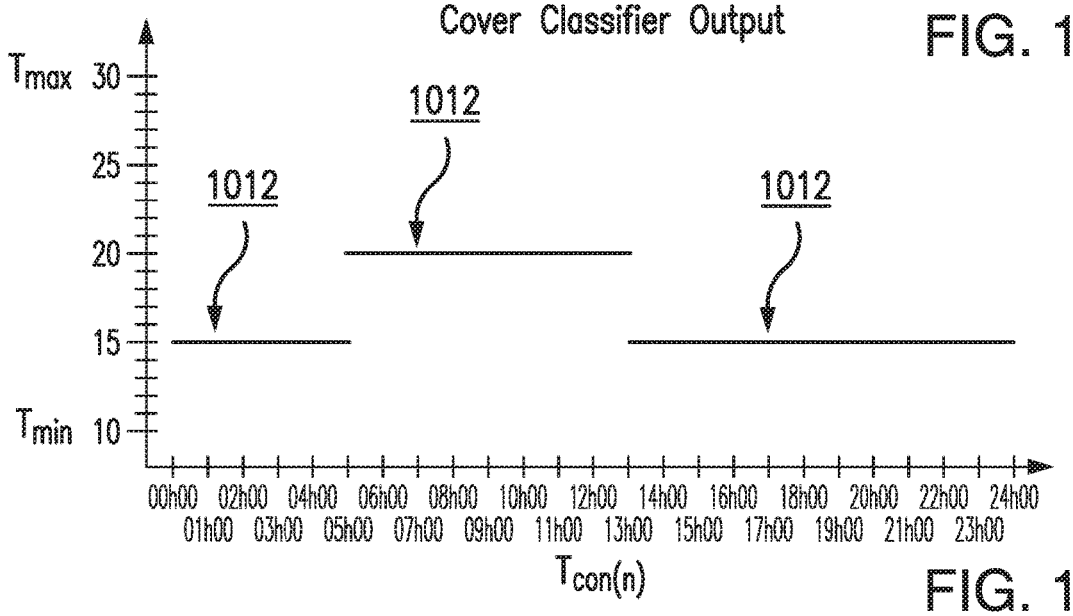
FIG. 10A3

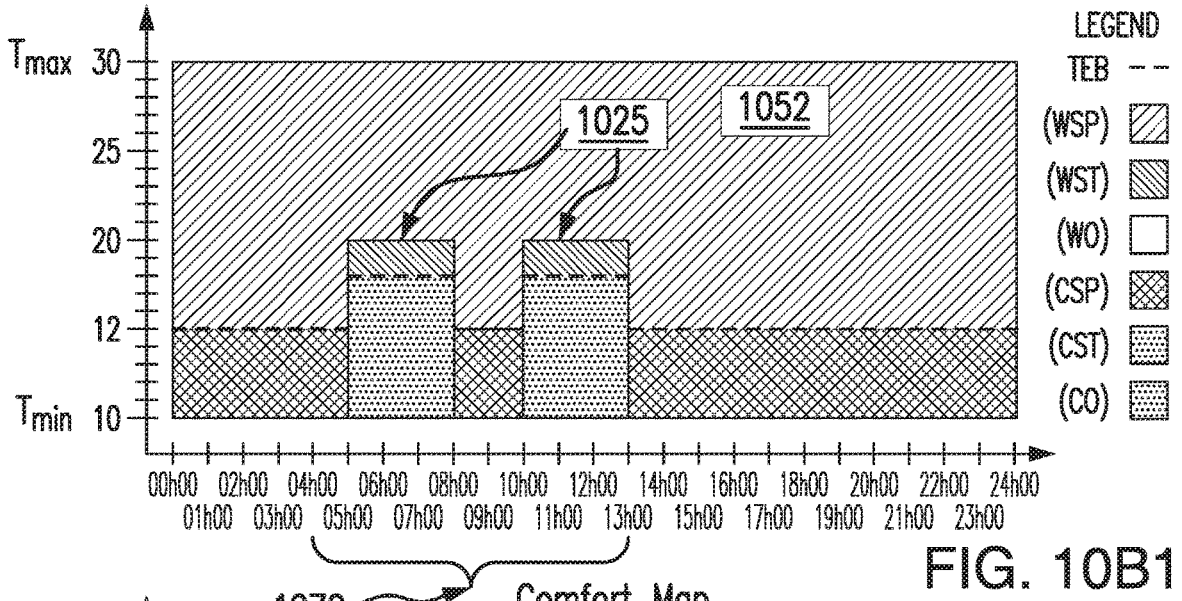
FIG. 10B1
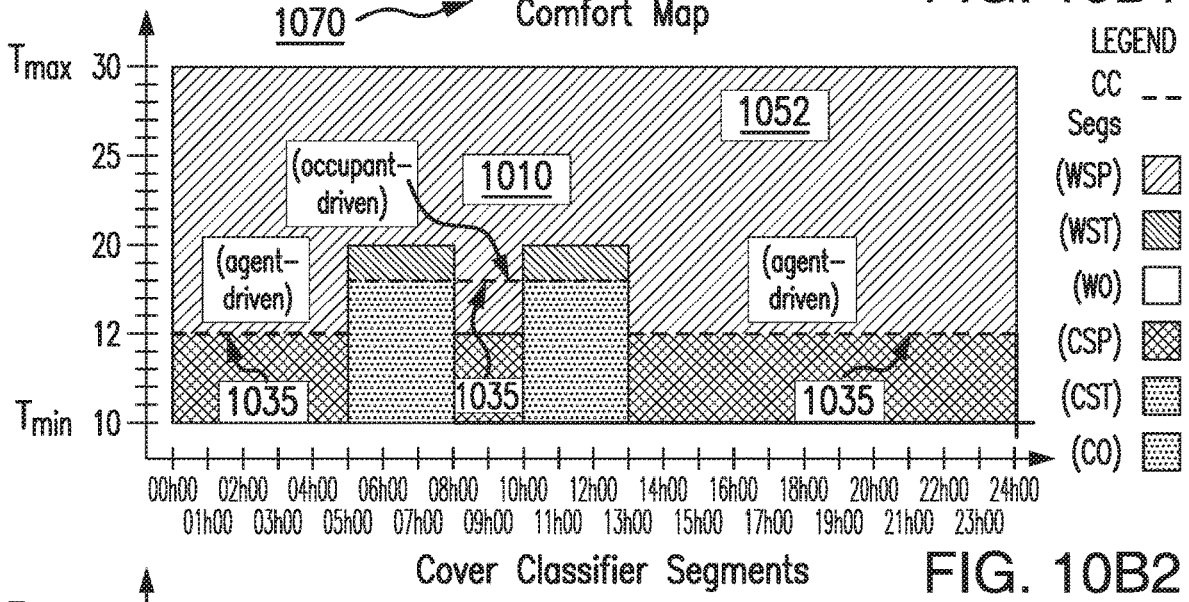
FIG. 10B2
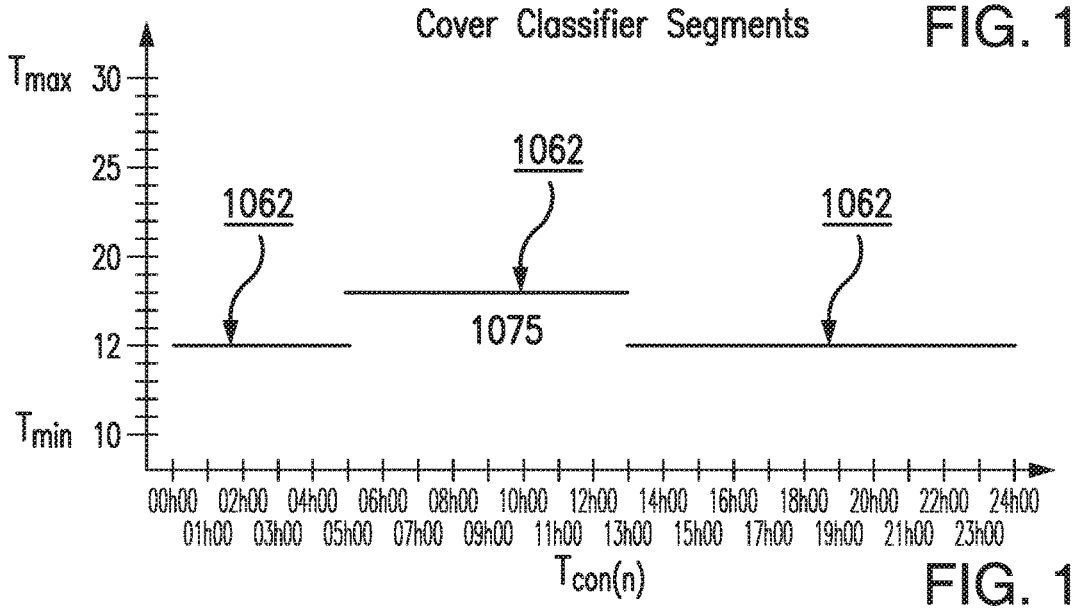
FIG. 10B3

INTERIOR USER-COMFORT ENERGY EFFICIENCY MODELING AND CONTROL SYSTEMS AND APPARATUSES USING COMFORT MAPS

This application claims the benefit of each of the following applications: (a) U.S. Provisional Application No. 62/110,393, filed Jan. 30, 2015 and titled "Interior Comfort HVAC User-Feedback Control System and Apparatus"; (b) U.S. Provisional Application Ser. No. 62/110,344, filed Jan. 30, 2015 and titled "Interior User-Comfort Energy Efficiency Modeling and Control Systems and Apparatuses"; (c) U.S. Provisional Application Ser. No. 62/110,386, filed Jan. 30, 2015 and titled "Interior Volume Thermal Modeling and Control Apparatuses, Methods and Systems"; (d) U.S. Provisional Application Ser. No. 62/110,398, filed Jan. 30, 2015 and titled "Apparatuses, Methods and Systems for Comfort and Energy Efficiency Conformance in an HVAC System"; and (e) U.S. Provisional Application Ser. No. 62/110,379, filed Jan. 30, 2015 and titled "Operational Constraint Optimization Apparatuses, Methods and Systems"; the entire contents of each of the aforementioned applications are herein expressly incorporated by reference.

This application for letters patent describes inventive aspects that include various novel innovations (hereinafter "disclosure") and contains material that is subject to copyright, mask work, and/or other intellectual property protection. The respective owners of such intellectual property have no objection to the facsimile reproduction of the disclosure by anyone as it appears in published Patent Office file/records, but otherwise reserve all rights.

RELATED APPLICATIONS

This application is related to and hereby incorporates the following concurrently-filed applications by reference:

U.S. application Ser. No. 14/956,082, filed Dec. 1, 2015 and titled "Interior Comfort HVAC User-Feedback Control System and Apparatus,"

U.S. application Ser. No. 14/955,971, filed Dec. 1, 2015 and titled "Interior Volume Thermal Modeling and Control Apparatuses, Methods and Systems,"

U.S. application Ser. No. 14/956,139, filed Dec. 1, 2015 and titled "Apparatuses, Methods and Systems for Comfort and Energy Efficiency Conformance in an HVAC System," and U.S. application Ser. No. 14/956,019, filed Dec. 1, 2015 and titled "Operational Constraint Optimization Apparatuses, Methods and Systems";

The entire contents of each of the aforementioned applications are herein expressly incorporated by reference.

FIELD

The present innovations generally address user environmental comfort management, and more particularly, include INTERIOR USER-COMFORT ENERGY EFFICIENCY MODELING AND CONTROL SYSTEMS AND APPARATUSES.

BACKGROUND

Users often use devices to control or modify the temperature in their homes. Such devices, however, may be unable to obtain, process and analyze user feedback to modify temperature settings to facilitate and balance providing optimal comfort and energy savings for the user.

BRIEF DESCRIPTION OF THE DRAWINGS

The accompanying appendices and/or drawings illustrate various non-limiting, example, innovative aspects in accordance with the present descriptions:

FIG. 5B1 shows a diagram illustrating comfort mode intervals in some embodiments of the IUCEEMC;

FIG. 5B2 shows a diagram illustrating comfort mode intervals in some embodiments of the IUCEEMC;

FIGS. 9A1-9B2 each show diagrams illustrating modified comfort map intervals in some embodiments of the IUCEEMC;

FIGS. 10A1-10B3 each show diagrams illustrating modified comfort map intervals in some embodiments of the IUCEEMC;

Generally, the leading number of each reference or citation number within the drawings indicates the figure in which that citation number is introduced and/or detailed. As such, a detailed discussion of citation number 101 would be found and/or introduced in FIG. 1. Citation number 201 is introduced in FIG. 2, etc. Any citation and/or reference numbers are not necessarily sequences but rather just example orders that may be rearranged and other orders are contemplated.

DETAILED DESCRIPTION

The methods, apparatuses, and systems (and component system modules) for INTERIOR USER-COMFORT ENERGY EFFICIENCY MODELING AND CONTROL ("IUCEEMC" or "system") described herein are configured to identify opportunities to achieve energy efficient operation in balance with user comfort. The IUCEEMC works to achieve energy efficiency gains through identification and exploration of periods of time where the temperature may be shifted to a lower operational energy state, while having a minimal impact on user comfort. In some embodiments, the IUCEEMC executes the shift to a lower energy state by changing comfort map element comfort characteristic variable settings. The change in the element comfort characteristic variables effectively moves a thermal equilibrium boundary for the comfort map up or down. In some implementations of the IUCEEMC, an execution temperature trajectory is derived from the comfort map's thermal equilibrium boundary. Accordingly, shifts in the thermal equilibrium boundary facilitate HVAC lower execution temperature trajectories for HVAC heating modes and HVAC higher execution temperature trajectory for HVAC cooling modes—both of which are effectively lower energy HVAC operational states. For purposes of illustration and discussion herein, exploration may be discussed within the context of shifting an element's comfort characteristic variable setting or shifting sections/segments of a TEB, again both of which, ultimately lead to achieving lower energy HVAC operational states.

In an implementation, the user, a system technician during commissioning, or a remote system administrator may tune the system to facilitate: (1) conservative exploration, where a system goal is to use minor shifts to elements/sections/segments to facilitate minor increments of temperature over time to achieve more efficient operation while having nearly unperceivable effect on user comfort; or (2) aggressive pushing exploration, where the system actively attempts to shift elements/sections/segments to facilitate changes in temperatures across episodes in a way that "pushes" for user comfort event feedback. The user feedback can then be used to earmark those boundary areas of user comfort sensitivity that should be avoided or carefully adjusted during future exploration events.

Figure 4:
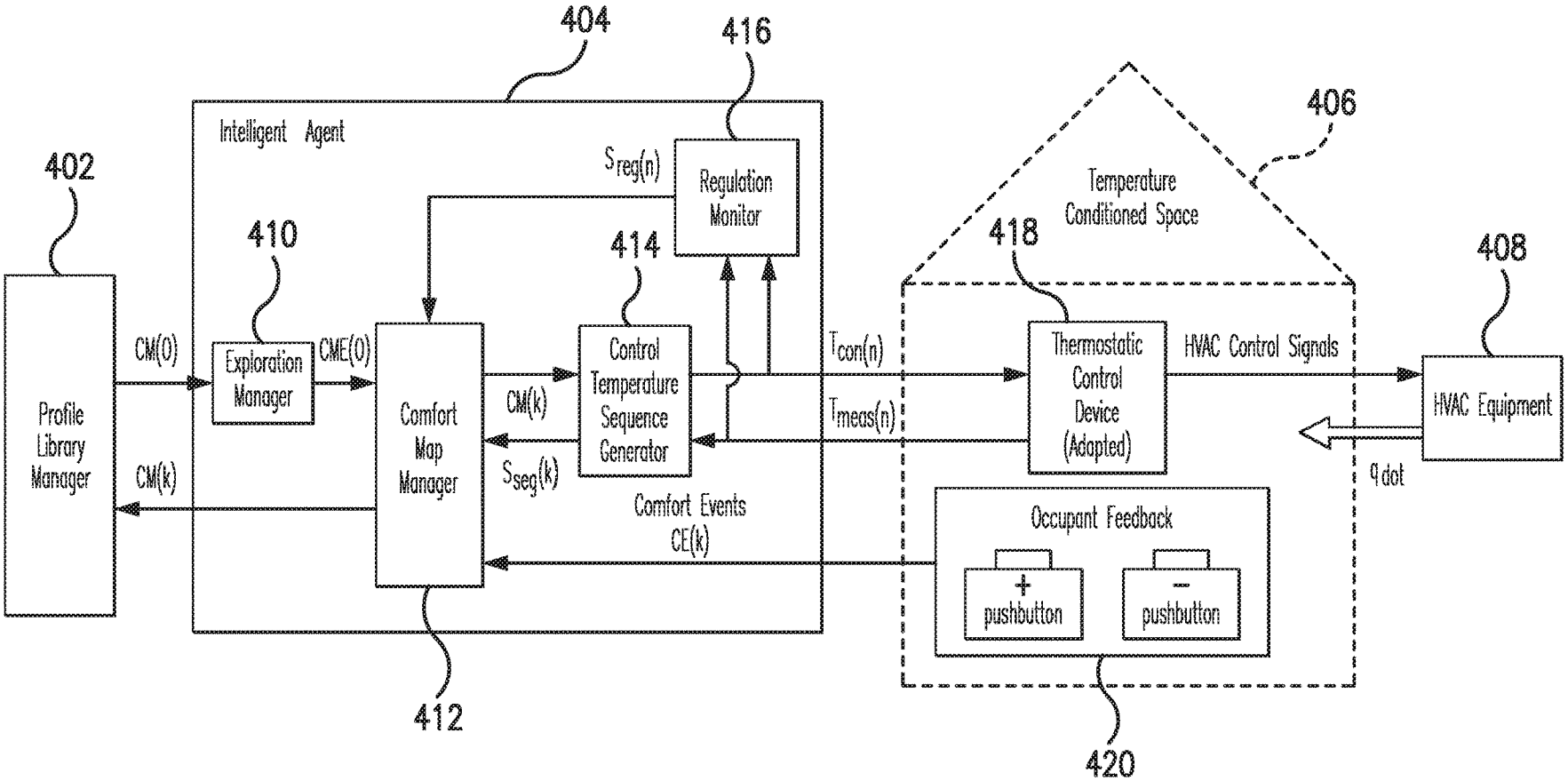
FIG. 4 shows a data flow diagram illustrating a comfort agent system in some embodiments of the IUCEEMC.
Figure 13:
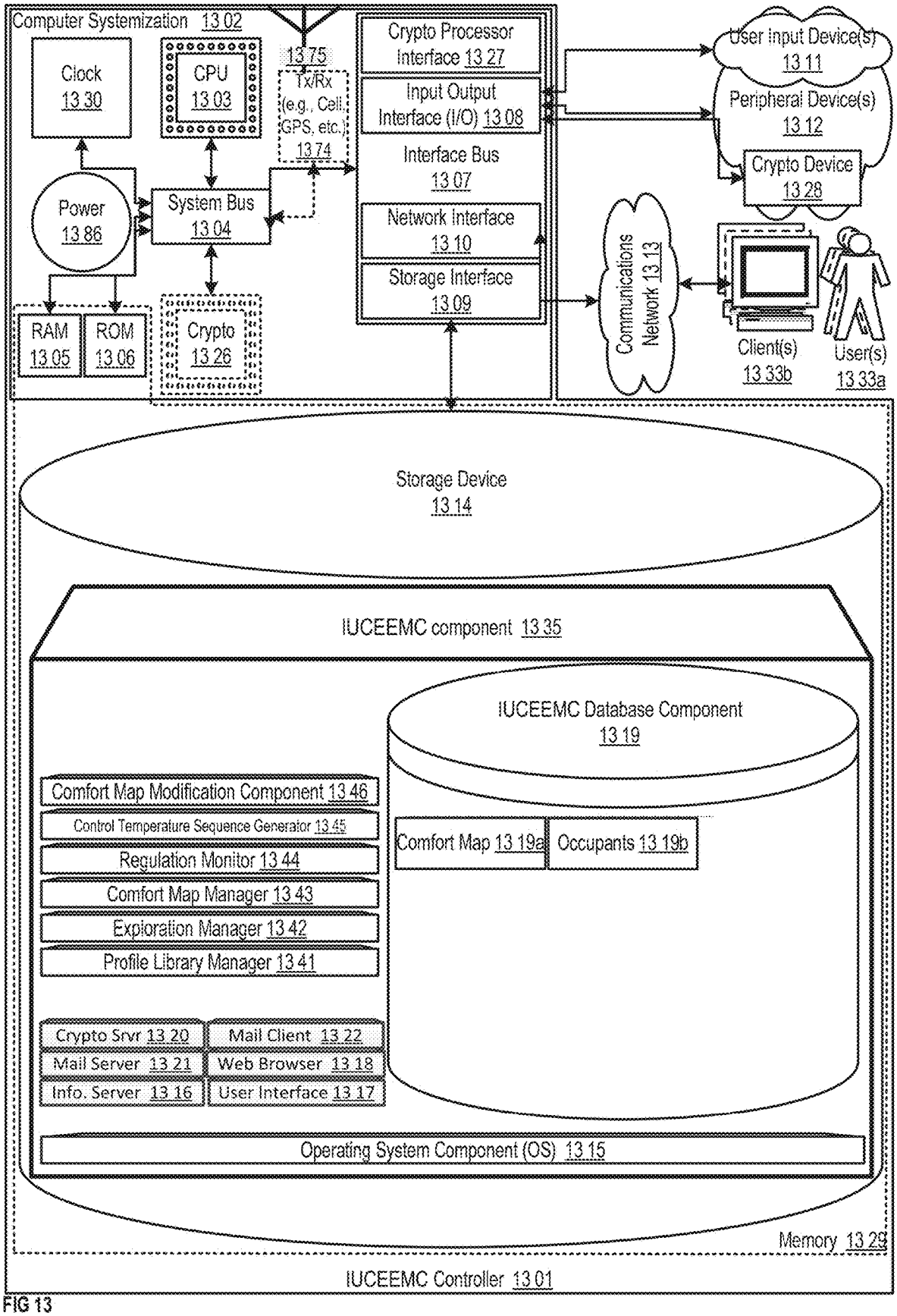
FIG. 13 shows a block diagram illustrating embodiments of a IUCEEMC controller.

In some implementations, the IUCEEMC, using the components as described in FIGS. 4 and 13, includes an intelligent agent (e.g., implemented as a hardware component or module storing processor-executable code, and/or implemented as a software component or module on the IUCEEMC) that makes exploration changes to a temperature model (e.g., a comfort map) for defining temperatures in a space, and/or can make dynamic changes to the model in response to occupant feedback. For example, the intelligent agent can use various components or modules (e.g., in the IUCEEMC, and/or implemented outside of the IUCEEMC), e.g., such as an exploration manager, a regulation monitor, a comfort map manager, and/or a control temperature sequence generator to determine/achieve efficiency gains either through conservative exploration (which intends to be unperceivable to an occupant) or pushing exploration (altering a temperature model to elicit occupant feedback). The system can then determine when occupant feedback has been provided, and/or to determine if and how to modify the temperature model based on the feedback provided.

In some implementations, the temperature model can be a comfort map, which can be implemented as an episode state space quantized into rectangular "elements" of both time and temperature. An episode (also referred to herein as a timespace) can correspond to a complete time cycle, such as a day (e.g., 24 hours), a week, and/or a similar span of time. For example, an episode state space in a comfort map can range from midnight of a first day to midnight of the next day on a first axis, and an operating temperature, (e.g., a range of 10 C.° to 30 C.°) on a second axis. Using such a model, time can be quantized into 10 minute intervals over the length of the episode, and temperature can be quantized into 0.5 degree intervals from the minimum operating temperature to the maximum operating temperature. A comfort map can include at least one episode state space, where each element within the episode state space may be assigned comfort characteristic variable setting and/or membership into one of two or more sets/subsets. For example, comfort characteristic variable settings or sets may include {W} as warm elements, {WS} as warm system (or agent) defined elements, {WST} as warm system defined transient elements, {WSP} as warm system defined permanent elements, {WOT} as warm occupant defined transient elements, {WOP} as warm occupant defined permanent elements, {C} as cool elements, {CS} as cool system defined elements, {CST} as cool system defined transient elements, {CSP} as cool system defined permanent elements, {COT} as cool occupant defined transient elements, {COP} as cool occupant defined permanent elements, or a variety of other possible comfort characteristic sets depending on the implementation. As discussed above, execution temperature trajectories for an HVAC system are derived from the thermal equilibrium boundary ("TEB"). For any time quantum, there is a temperature above which all time-temperature pairs are in the set {W} and below which all time-temperature pairs are considered to be in the set {C}. For an episode, a boundary temperature sequence is the thermal equilibrium boundary, abbreviated TEB, and represents the temperature(s) at the corresponding time quantum which occupants are neither too cool nor too warm i.e. a time/temperature sequence the system believes the occupants will likely consider "comfortable". Further details on the comfort map and the TEB may be found in concurrently-filed U.S. application Ser. No. 14/956,082, filed Dec. 1, 2015 and titled "Interior Comfort HVAC User-Feedback Control System and Apparatus," which is herein expressly incorporated in its entirety by reference.

In balancing energy efficient operation and steady state user comfort, the system implements an exploration type (e.g., conservative exploration, pushing, or a different exploration methodology that can be tailored to how much energy efficiency a user would like to achieve at the expense of adjusting temperature to a lower energy state mode of operation). Exploration may be discussed within the context of several key functionalities: (1) proposed exploration element/segment/section identification; (2) determination of exploration magnitude; (3) segment adjustment; and (4) comfort map update/temperature trajectory execution. In some implementations, the segment identification component also includes segment validation functionality. Also, in certain instances if comfort event user feedback is received, the changes to elements/segments/sections of comfort map may be reverted back to settings that were in place prior to the comfort map modification/update with exploration changed elements/segments/sections.

The intelligent agent and/or the component modules described can use various mechanisms to achieve identifying proposed exploration elements/segments/sections of the comfort map to shift to achieve a lower HVAC operational energy state. In an example, the system can identify proposed exploration segments and modify the proposed segments of the comfort map if the proposed segments are validated. Examples of such proposed segment identification algorithms include: (1) using the TEB to divide the comfort map into portions and identifying a continuous temperature TEB sequence as a proposed exploration segment (illustrated in FIGS. 7A-9B2 and discussed in greater detail below), and/or (2) using a cover classifier segment identification algorithm to identify a cover classifier defined segment(s) as the proposed segment to shift within the comfort map (illustrated in FIGS. 10A1-10B3 and discussed in greater detail below). In some examples, the system implements proposed segment identification based on optimizing segments/areas of constant temperatures, and/or otherwise using cover segments. Additional discussion of features and functionality of cover classifier functionality may be found in concurrently-filed U.S. application Ser. No. 14/956,139, filed Dec. 1, 2015 and titled "Apparatuses, Methods and Systems for Comfort and Energy Efficiency Conformance in an HVAC System," the entirety of which is herein expressly incorporated by reference.

Figure 1:
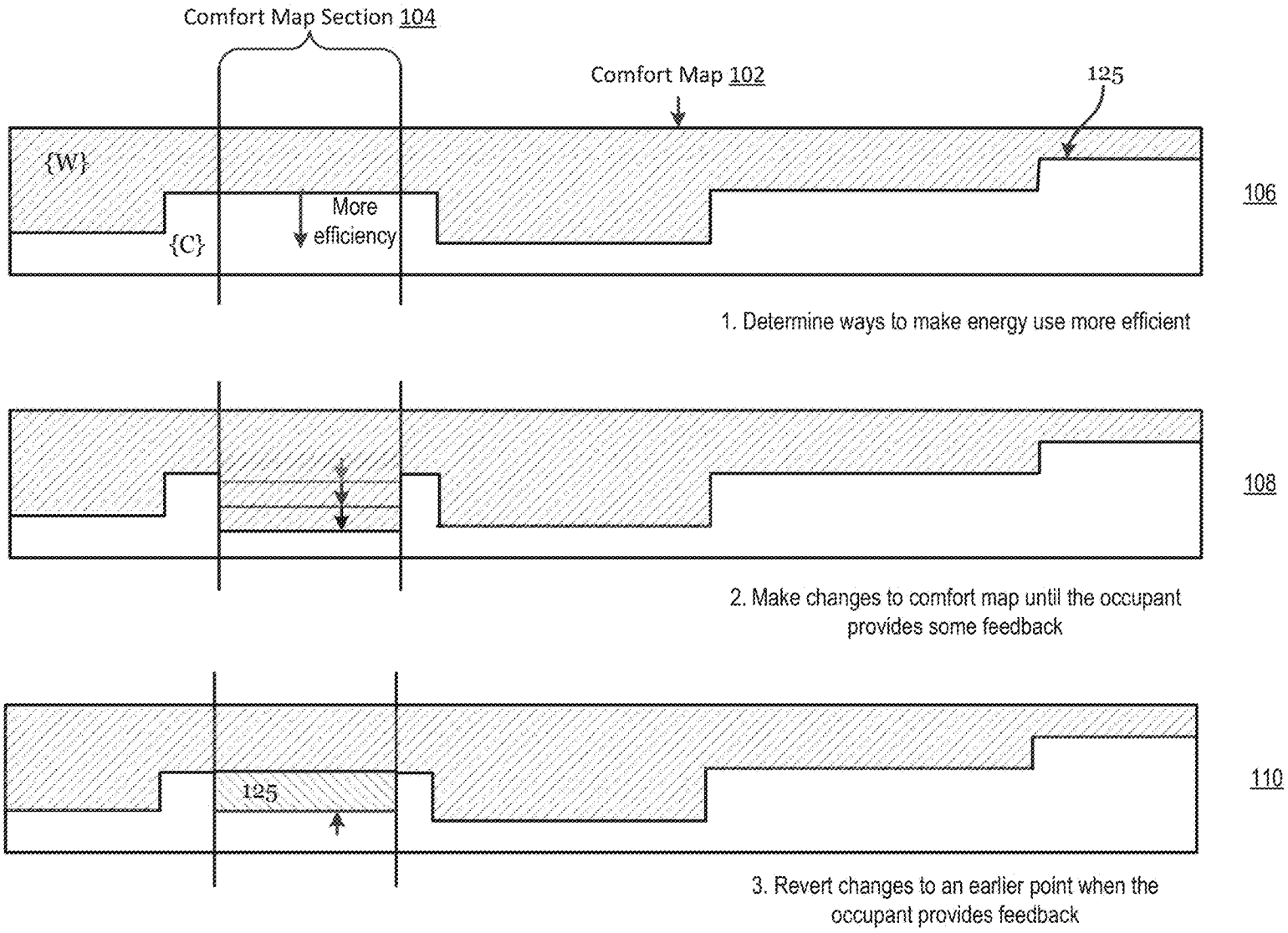
FIG. 1 shows a block diagram illustrating an example of modifying aspects of comfort maps in some embodiments of the INTERIOR USER-COMFORT ENERGY EFFICIENCY MODELING AND CONTROL SYSTEMS AND APPARATUSES (IUCEEMC)
Figure 2:
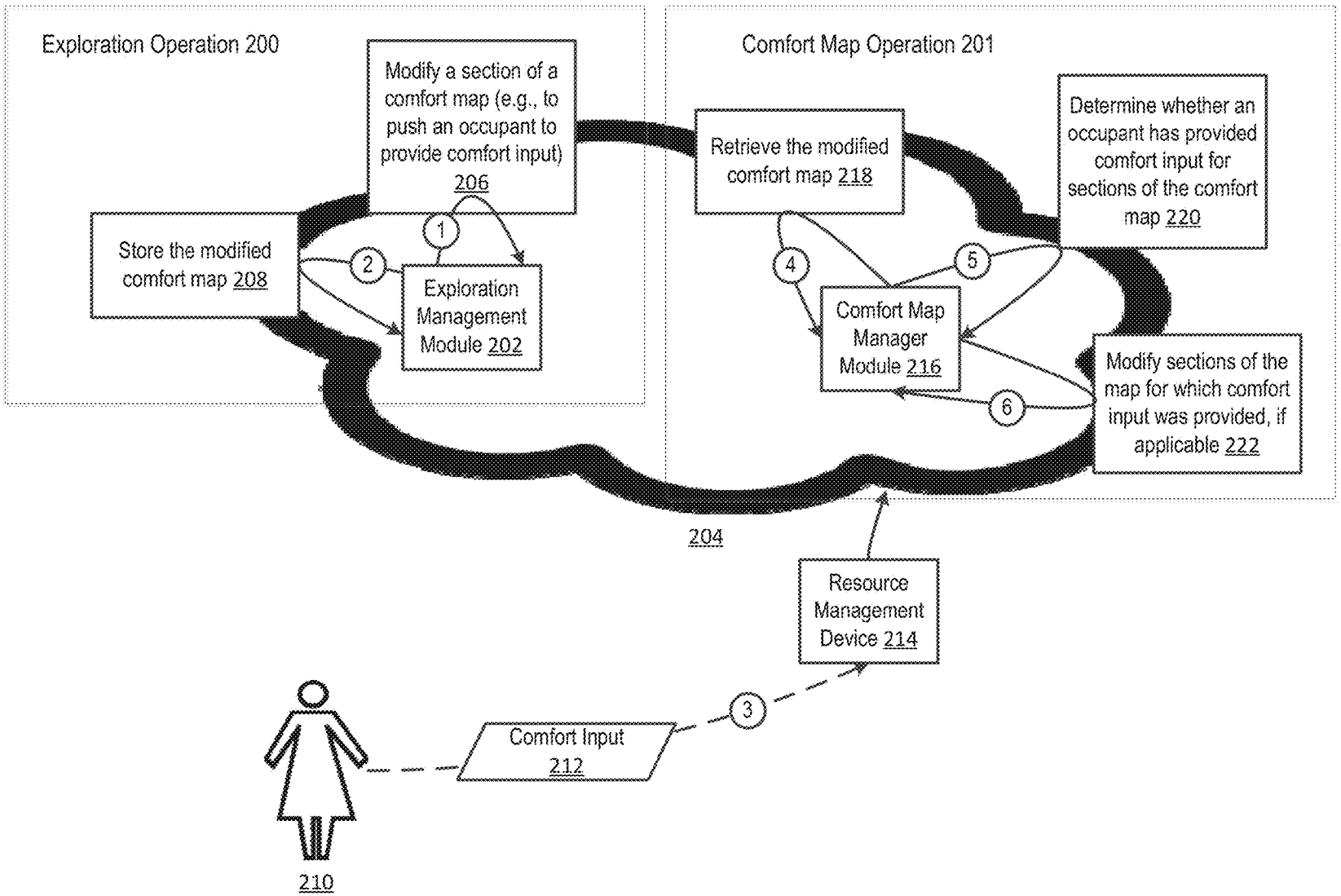
FIG. 2 shows a data flow diagram illustrating aspects of exploration for some embodiments of the IUCEEMC.

FIG. 1 and FIG. 2 illustrate an example of how system components or modules utilize a comfort map and a TEB to balance user comfort with exploration opportunities to achieve energy efficiency gains, as well as aspects of the system components or modules that execute such system functionality.

FIG. 1 shows a diagram of a comfort map 102 in three exploration states (1) proposed section/segment identification 106; (2) proposed section/segment shifting achieved through element comfort characteristic variable setting changes 108; and (3) proposed segment reversion 110 for an example embodiments of the IUCEEMC. For example, a comfort map 102 can include element comfort characteristic set information {W} and {C} that defines a TEB as comfort map comfort levels within a site (e.g., an occupant's residential home, and/or similar sites) as a TEB sequence 115. The comfort map 102 can be used to derive and ultimately calculate temperature settings throughout specified periods of the day as an execution temperature trajectory derived from the TEB sequence 115. To encourage energy efficiency (e.g., to reduce energy consumption, to lower energy costs, and/or for similar reasons), the IUCEEMC can divide the TEB sequence in the comfort map 102 into comfort map proposed sections/segments 104. As discussed above, the proposed section corresponds with comfort map elements that have comfort characteristic variables that in turn define a TEB interval in time. Changes to the element comfort characteristic variables over the proposed comfort map section 104 can shift the TEB up or down respectively across the interval of section/segment 104. To achieve lower energy operation for an HVAC system operating in heating mode, the comfort map elements' comfort characteristic variables are changed to shift the TEB down as illustrated in 106 and 108. If the HVAC system is operating in a cooling mode the comfort map elements' comfort characteristic variables are changed to shift the TEB up (not illustrated) in order to achieve lower energy HVAC operation.

These proposed comfort map sections/segments 104 (and the corresponding comfort map elements) can then be analyzed such that the IUCEEMC can determine 106 how to reduce energy during particular sections of the comfort map 104. Such analysis can also be used to better refine system data related to knowledge of the user's comfort characteristic data at particular portions of the day. The IUCEEMC can then make incremental/decremental changes 108 (e.g., depending on HVAC operational mode, changing comfort map element comfort characteristic variables to facilitate a decrement or increment (e.g., of 0.5 C.°, 1.0 C.°, 1.5 C.° or another unit based on implementation resolution) to ultimately achieve thermostat/HVAC system lower state energy operation. In an implementation the proposed changes may be of a permanent and/or temporary nature, also described as persistent and/or transient changes, respectively. Furthermore, in some implementations the magnitude of the proposed changes may be selected to encourage the user to provide comfort feedback to the IUCEEMC over intervals where no or minimal user comfort feedback data has been received by the system. If the user does not provide comfort input in response to the executed exploration section, the IUCEEMC can continue to make incremental segment/section changes, can make temporary changes permanent, and/or can perform a number of related actions as described below. Subsequent changes may take place over the course of one or more subsequent episodes. In certain implementations, if the user does provide comfort user feedback, the IUCEEMC can (a) revert 110 at least some of the transient exploration changes back to a previous state, (b) dismiss temporary changes, and/or (c) perform a number of related actions as described below. For illustrative purposes, many of the proposed exploration portions are discussed as one proposed change per episode, however depending on the implementation, the system may propose more than one comfort map change/modification per episode.

FIG. 2 illustrates a diagram of the system components or modules executing exploration activity 200, as well as coordinating comfort map management 201. For example, the IUCEEMC includes an intelligent agent which includes several system components or modules such as in turn, a comfort map manager 216 that receives processes, analyzes user comfort event feedback data and can initiate/manage changes to a comfort map 102. The IUCEEMC can use the intelligent agent to implement exploration activity 201 managed by the exploration manager 202. Depending on the implementation, various features and functionality may be executed locally, remotely or in a distributed implementation where some elements thereof are executed locally and some executed remotely. In an implementation, the ICEEMC intelligent agent's exploration manager 202 determines whether and how to identify and develop proposed exploration changes in a comfort map. The exploration manager 202 may also validate the proposed changes prior to transferring the updated comfort map with proposed changes to the comfort map manager 216 for execution.

The comfort map manager 216 communicates with the HVAC system to generate and execute an execution temperature trajectory, as well as manages comfort event user feedback. The comfort map manager 216 can also manage persistent and/or transient proposed segment/section (via underlying element) changes and how the changes are managed within the comfort map 102 based on comfort event user feedback data 212. In an example, the intelligent agent includes exploration manager 202 configured to facilitate exploration functionality 200 and in some aggressive exploration implementations, propose changes scaled and designed to solicit some sort of comfort event feedback from the user. In another example, the exploration manager 202 executes conservative exploration attempting to make proposed energy saving comfort map adjustments such that the user does not notice the change in execution temperature trajectory. The intelligent agent also includes a comfort map manager 216 to manage and facilitate comfort map functionality 201. For example, comfort map functionality 201 may include making changes to the comfort map 102 based on comfort event data, reverting and/or otherwise altering proposed changes made to the comfort map 102. In normal comfort map mode operation, proposed comfort map exploration changes can be effectively rejected or modified through comfort user feedback data 212 (as described in greater detail in co-pending U.S. application Ser. No. 14/956,082, filed Dec. 1, 2015 and titled "Interior Comfort HVAC User-Feedback Control System and Apparatus"). For transient proposed comfort map changes, reversion may also be initiated based on comfort event user feedback data 212 that is processed by the comfort map manager 216. Such reversion data may be associated with and/or stored with the comfort map to effectively change the element comfort characteristic variable settings back to a previous setting to reject transient exploration changes. Also, in some instances, the IUCEEMC can determine rollback points, e.g., where the IUCEEMC reverts the portion of the comfort map 102 back to its state at the rollback point, to account for the possibility that there is a delay between when the comfort map 102 is modified, and when the user provides feedback 212 in response to the proposed transient section/segment modification.

As will be discussed in greater detail below, the IUCEEMC system exploration manager 202 can also identify and select sections/segments to propose to modify (or leave alone) based on numerous factors, such as (1) probability calculations for each portion of the comfort map 102 and/or (2) indications of whether the portion of the comfort map 102 is agent-driven (e.g., determined/established by the IUCEEMC) and/or occupant-driven (e.g., determined/established by the occupant via user comfort feedback data), and/or various other factors. The IUCEEMC can also use partitioning algorithms, such as algorithms which use values and/or characteristics of the thermal equilibrium boundary (also described herein as TEB) and/or cover classifiers or other methods to determine how to divide the comfort map 102 into portions (and the corresponding underlying element comfort characteristic variables) can be proposed to be modified and/or monitored.

Depending on the implementation, the ICEEMC components and/or system modules can work together to facilitate segment identification/verification, segment modification, comfort map update/incorporation, execution temperature trajectory derivation for a single episode or as a process spanning several episodes. For purposes of illustration and the discussion of FIG. 2, exploration manager 202 is discussed as working to provide the comfort map manager 216 with a modified comfort map that includes proposed comfort map segment exploration modification (and associated comfort map comfort characteristic element modifications) at the beginning of a particular episode. FIG. 2 shows a data flow diagram illustrating aggressive exploration by the exploration manager 202 incentivizing a user to provide comfort input in some embodiments of the IUCEEMC. It is to be understood that in alternate embodiments, the magnitude of exploration manager's 202 proposed segment temperature changes can be scaled back to achieve energy efficient operation in a way that works to minimize user perception of any change in temperature.

As illustrated in FIG. 2, IUCEEMC 204 system components/modules include an exploration manager 202 which can identify, propose and modify 206 a section of a comfort map. The exploration manager 202, for example, can make persistent and/or transient changes (to be discussed in greater detail below) to the section of the map. Further, in some implementations, the exploration manager 202 can scale proposed changes to solicit input from the user and quickly lower the operational energy consumption. The exploration manager can work with a comfort map manager 216 to store 208 the modified comfort map updated by the exploration manager 202 proposed segment modifications (e.g., on a cloud server database, in a profile library manager as described in FIG. 4, and/or a similar location). In other implementations, the exploration manager 202 provides the modified comfort map directly to the comfort map manager 216 for episode execution. The comfort map manager 216 uses the modified/updated comfort map to work with a control temperature sequence generator to generate a control temperature sequence/execution temperature trajectory for execution by the HVAC system during a given episode (as described in greater detail in FIG. 4).

After proposed segment/section modifications are incorporated into the updated comfort map through changing the corresponding element comfort characteristic variables by the exploration manager 202, the comfort map manager 216 can then access/retrieve 218 the modified/updated comfort map to execute comfort map operation 201 for an episode. The comfort map manager 216 works with the control temperature sequence generator (as described in greater detail in FIG. 4) to facilitate determination/calculation of a control temperature sequence that incorporates the proposed segment updates. If the comfort map manager 216 determines during episode execution that an occupant has provided comfort event/input 220 that corresponds to exploration manager 202 proposed segments/sections/elements of the comfort map, the comfort map manager 216 can determine whether and how best to modify 222 the comfort map sections for which comfort event/input was provided. In some implementations, for example, the comfort map manager 216 can revert or change the exploration section/elements of the comfort map (or portions thereof) to produce a more comfortable control temperature sequence for the occupant based on the occupant's comfort input. Comfort map/comfort event data updates are discussed in greater detail in co-pending U.S. patent application Ser. No. 14/956,082 (the entirety of which is herein expressly incorporated by reference). The comfort map manager 216 can work with the comfort map data to determine whether the proposed exploration segment (or portion thereof) needs to be reverted or can be made persistent. At the beginning of the next episode, the exploration manager 202 can then propose additional transitory and/or persistent changes to the comfort map, (e.g., based on the occupant's comfort event data feedback and/or lack thereof), and/or based on criteria described above.

Figure 3:
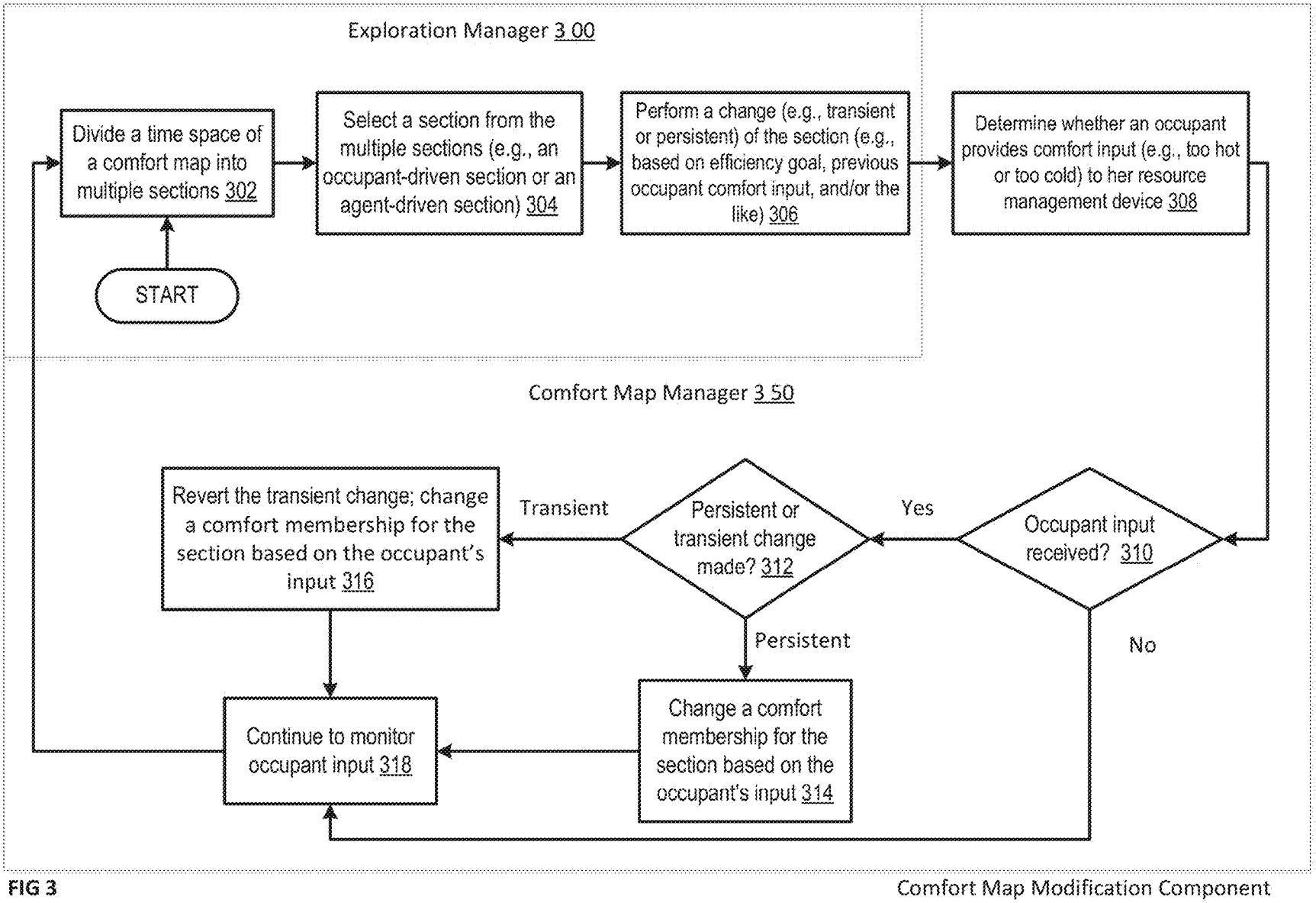
FIG. 3 shows a logic flow diagram illustrating aspects of exploration for some embodiments of the IUCEEMC.

FIG. 3 shows a logic flow diagram illustrating aspects of exploration manager 300 and comfort map manager 350 working together. In FIG. 3, the comfort map manager 350 determines whether and how exploration manager proposed transitory segments are made permanent, remain transient for another episode, and/or are reverted back to a previous comfort map (in other implementations, this may be executed by the exploration manager 300). More specifically, the system (1) exploration manager 300 updates a comfort map with proposed segment/section modifications 351; (2) the comfort map manager 350 executes the updated comfort map 352; and (3) the comfort map manager 350 determines if a comfort event is received that corresponds with a proposed exploration modification segment (or portion thereof) on the updated comfort map 305. As discussed above, reversion involves changing the comfort map elements' comfort characteristic variable setting back to a pre-exploration state.

The exploration manager's 300 identification of proposed segment/section modifications can be implemented several ways. In some implementations, exploration manager 300 can access a comfort map at the beginning of an episode and divide 302 an episode state space into multiple sections (e.g., comfort map time partitioning). In a partitioning example, the comfort map can be divided into sections of equal length, one of which is selected as a proposed section for exploration modification. In other exploration proposed segment development methods, the comfort map can be divided into sections based on a number of other criteria, such as into sections as defined by partitioning algorithms using segments developed by a cover classifier, through operational constraint (e.g., the Max/Min temperatures discussed in FIG. 6) and/or TEB values.

The exploration manager 300 can select 304 at least one section/segment from the multiple sections/segments for proposal to transition to a lower HVAC operational energy state. Alternately, segment identification/selection can be based on a probability analysis and/or based on other such criteria. The exploration manager 300 can then propose the selected a transient and/or persistent change 306 to a section/segment of the comfort map, e.g., based on an efficiency goal of the IUCEEMC, based on any previous occupant comfort characteristic data/input, and/or based on other such criteria. To facilitate exploration changes, the exploration manager 300 changes the comfort characteristic variable setting associated with comfort map elements that correspond to the proposed segment/section.

In a subsequent episode, a comfort map manager 350 can then determine 308 whether to make transient segment changes permanent within the comfort map. In some embodiments, the process of making transient segment changes permanent may be implemented in the exploration manager 300. The comfort map manager 350 can make the determination to make transient proposed changes permanent based on one or more factors including whether an occupant provides, and/or has provided, comfort event data/input to a resource management device. If the occupant has not provided 310 comfort event data/input, the comfort map manager 350 can continue to monitor 318 occupant comfort event feedback data episode after episode and determine when occupant comfort event feedback data is provided (if at all). If a number of episodes pass without comfort event data being received during a proposed transient segment, either the exploration management manager 300 or the comfort map manager 350 can make the transient segment a persistent segment change to the active comfort map—thereby adopting the modified element comfort characteristic settings. Conversely, if the occupant has provided 310 comfort event data/input for a section of the comfort map that overlaps with an exploration proposed segment, the comfort map manager 350 may revert a portion of or the entire proposed segment and change the modified element comfort characteristic settings back to a previous state—the state of the comfort map element comfort characteristic variable settings from before the proposed segment was incorporated.

By analyzing the comfort characteristic variable settings or set/subset data for the comfort map elements, the comfort map manager 350 can determine 312 whether a persistent or a transient proposed change was last made to one or more section(s) of the comfort map, as well as whether the proposed change overlaps a comfort event window for which the occupant provided comfort event feedback data/input. If the proposed change made was a transient change, the comfort map manager 350 can revert 316 the transient change and can also further modify the section of the comfort map by changing comfort characteristic set membership of portions of the section of the comfort map based on the occupant's comfort event data/input. If an exploration proposed segment/or element change made was a persistent change, however, reversion is not possible and the comfort map manager 350 would process the comfort event data in the same way it would process any comfort event regardless of any potential exploration. The comfort map manager 350 may be able to instead change 314 a comfort characteristic set membership for portions of the proposed section of the comfort map (e.g., based on the comfort map's comfort characteristic data and occupant's comfort event data/input). Further examples of how the comfort map manager may modify the comfort map and/or comfort membership for portions of the section of the comfort map are discussed in co-pending application U.S. patent application Ser. No. 14/956,082 (herein incorporated by reference).

FIG. 4 shows a data flow diagram illustrating an intelligent agent system 404 in some embodiments of the IUCEEMC and discusses aspects of the components or system modules used to identify (and in some implementations validate) proposed segment/sections for exploration. For example, in some implementations, the IUCEEMC can support exploration of the comfort space by an intelligent agent 404 proposing and testing exploration hypotheses using system components or modules, refining the comfort map in the process to balance energy efficient operation with user comfort. The intelligent agent 404 includes exploration manager 410, comfort map manager 412, control temperature sequence generator 414 and regulation monitor 416 to achieve this balance.

In one implementation, a regulation monitor 416 can compare the control sequence temperature $T_{con}(n)$ against the measured temperature sequence $T_{meas}(n)$, to determine the state of regulation of a closed-loop temperature control subsystem comprising a temperature conditioned space 406, a thermostatic control device 418 and a HVAC equipment 408. The regulation monitor 416 generates an output as regulation monitor state, denoted $S_{reg}(n)$ (described subsequently). In some implementations the regulation monitor state is used in coordination with the comfort map data by the exploration manager as part of the exploration proposed segment identification/validation process. Regulation monitoring and proposed segment validation is discussed in greater detail below with regard to FIGS. 10-12.

The system includes exploration manager 410 that can access/accept a comfort map CM(o) and corresponding comfort map metadata such as $S_{reg}(n)$ from profile library manager 402, and in some implementations may include user comfort feedback data such as comfort event reference time or temperature from the comfort events associated with the previous episode, and make proposed segment/section modifications to the comfort map prior to the beginning of the episode. These proposed modifications can produce an updated/modified comfort map, shown as CME(o) and in turn forms the basis for the Control Temperature Sequence Generator 414 to derive the execution temperature trajectory/control temperature sequence $T_{con}(n)$ for execution via thermostatic control device 418 for the episode. In turn, thermostatic control device 418 controls a temperature conditioned space 406 by operating HVAC equipment 408 to add or remove heat to/from space 406. During the course of an episode, occupants can interact with the system when discomfort is perceived via an occupant feedback device 420 that generates comfort events CE(k) that are processed, analyzed and may be used to update and/or modify the comfort map. This modified map CM(k) can be stored back into the profile library manager 402 at the end of the episode and used by exploration manager 410/comfort map manager 412 at the beginning of the next/subsequent episode(s). $T_{meas}(n)$ is also an element associated with comfort event feedback data, specifically in some implementations, the system uses the measured temperature at the time of a comfort event to establish a comfort event reference point for comfort event window development.

At least two types of comfort events can be issued by occupant interaction via occupant feedback device 420. An occupant can, for example, issue a "plus" comfort event when the occupant perceives the temperature conditioned space 406 to be subjectively cool, and a "minus" comfort event when the occupant perceives the temperature conditioned space to be subjectively warm. Comfort events can be interpreted by comfort map manager 412, which can in turn mark/update the comfort characteristic/set membership for a region the comfort map (e.g., a region around the time and measured temperature of the comfort event) as either cool in the case of a plus comfort event, or warm in the case of a minus comfort event. By implementing comfort characteristic set rules and avoiding regions of the comfort map marked cool when in the heating comfort mode and warm when in the cooling comfort mode, the control temperature sequence generator 414 can adjust the executed temperature trajectory in the temperature conditioned space 406 to better meet the occupant requirements for comfort.

The closed loop feedback scheme described above results in a control temperature sequence that facilitates occupant comfort. In some implementations, other temperature sequences can also satisfy occupant comfort requirements while simultaneously transitioning to a lower energy operational state through implementing exploration controls. Lowering temperatures in the heating comfort mode and raising temperatures in the cooling comfort mode can use less energy, the system may proceed to find and use the highest temperature considered comfortable by a user at any given time in the cooling comfort mode, and the lowest temperature in the heating comfort mode. Systems and methods described herein can determine and/or approximate these temperatures using comfort map/occupant comfort event feedback interaction as a guide for developing viable efficiency hypothesis/proposed segment/sections and effectively balancing user comfort and energy efficient operation. The TEB represents a temperature sequence over time which approximates the occupant comfort. It is recognized that subjective comfort can hold over a range of temperatures. When minimizing energy consumption is an objective, the TEB can be one estimate of the temperature of minimum energy consumption still considered comfortable by the occupant at a given time.

In particular, there can be comfort map intervals (e.g., segments) in time over the course of an episode over which no comfort events have been incurred. This can occur when the occupants are not physically in the temperature conditioned space 406 during the interval (e.g., during work hours on a weekday), or when the control temperature sequence over the interval is considered comfortable by the occupants. In either case, these intervals can provide an opportunity for energy efficiency savings through exploration by an intelligent agent 404. This type of exploration can lead to lower energy state operation as the HVAC system has decreased energy consumption requirements over such an interval by increasing the temperature of the temperature conditioned space 406 over an interval in the cooling comfort mode, or by decreasing the temperature of the temperature conditioned space 406 over an interval in the heating comfort mode. For example, in some implementations the system can modify the comfort map elements to increase the TEB (or a segment of the TEB) sequence in the cooling comfort mode or to decrease the TEB (or a segment of the TEB) sequence in the heating mode to a lower energy operational state. Depending on the implementation, the proposed changes can be either persistent or transient. In some implementations, the system may store the previous comfort map data to provide a reversion point if the proposed comfort map modifications are made transient by the system, alternately reversion can be achieved by analyzing comfort characteristic set/subset data. Accordingly, if the occupants feel subjective discomfort and provide comfort event feedback to a resource management device 420 (e.g., a thermostat, a mobile device running a resource management mobile application, and/or a like device) during a period of time that corresponds with a proposed exploration change, the comfort map manager can revert the comfort map modifications and shift the affected region of the comfort map back to its previous state. In some implementations, by learning to push these boundaries in regions where no occupant feedback has been received until the occupants react via comfort events, the intelligent agent 404 can learn to identify and execute opportunities to aggressively reduce energy consumption while maintaining occupant comfort.

In some implementations, to facilitate exploration certain regions of the comfort map can be identified as proposed segment modifications based on comfort characteristic data and/or comfort characteristic set membership. For example, the system exploration manger 410 can identify/test comfort map exploration segment(s) where the TEB for each element/region has not been established via a comfort event, i.e., elements that have comfort characteristics established by the system. The inverse is also possible, the system exploration manager 410 can test comfort map exploration segment(s) where the TEB for each element/region that has been established via a comfort event—which is the example illustrated in FIGS. 8, 9A and 9B. The collection of elements marked subjectively cool or with a cool comfort characteristic in the comfort map is referred to as the set {C} of elements. Elements/regions of the comfort map can be assigned membership by the intelligent agent 404 or assigned membership by virtue of occupant initiated comfort events. Depending on the implementation, the element(s) can be marked for membership in one or more subset(s) of the set {C} as members of:

A subset {CS}, which indicates that the system intelligent agent 404 assigned a given element in the comfort map to the set of elements marked {C} or the element has a system defined cool comfort characteristic.

A subset {CO}, which indicates that the occupants via a comfort event assigned a given element in the comfort map to the set of elements marked {C} or the element has an occupant defined cool comfort characteristic.

Similarly, each element marked {W} or with a warm comfort characteristic above can be further refined as belonging to one or more of two subsets:

A subset {WS}, which indicates that the system intelligent agent 404 assigned a given element in the comfort map to the set of elements marked {W} or the element has a system defined warm comfort characteristic.

A subset {WO}, which indicates that the occupants via a comfort event assigned a given element in the comfort map to the set of elements marked {W} or the element has an occupant defined warm comfort characteristic.

Additional/supplemental sub-setting is also possible. For example, persistent and transient sub-sets are discussed in greater detail below.

If the subsets above are used to determine which elements of the comfort map can be designated as being subjectively "cool,", then at each time quantum of the comfort map, the intelligent agent 404 and/or the exploration manager 410 can determine whether the TEB of a time quantum of the comfort map has been established by the occupants or the system by analyzing set/subset membership along the TEB as will be described in greater detail below.

The TEB is the point of transition in temperature at a given time from the set {C} or any of its subsets to the set {W} or any of its subsets, independent of the HVAC operational comfort mode (e.g., heating or cooling). In the heating comfort mode, if an element at the TEB is already assigned to the subset {CO}, the intelligent agent 404 can interpret the temperature of the TEB to be inviolate and choose to not alter the TEB in any persistent way, as it was established via a comfort event. Instead, the system may propose a transient change to fine tune the TEB to potentially save additional energy. Similarly, in the cooling comfort mode, if an element of the TEB at a time quantum is already assigned to the subset {WO}, the intelligent agent 404 can interpret the TEB temperature to be inviolate and choose not to alter the TEB in any persistent way, as it was established via a comfort event. Instead, the system may proposed a transient change to fine tune the TEB to potentially save additional energy. The TEB for a time quantum satisfying either of the above can be defined as a member of an occupant-driven set/sub-set for the applicable comfort mode. If the TEB does not satisfy the above for the particular applicable comfort mode, the TEB for that time quantum can be defined as a member of a system/agent-driven set/sub-set for the applicable comfort mode.

The system intelligent agent 404 can apply exploration in many different ways to achieve refinement or identify proposed sections for operating at lower energy state and thereby gain energy efficient operation. For example, the system may use a cover classifier developed segments as the basis of exploration hypothesis/proposed segment/section modifications as illustrated in the example shown in FIGS. 10A, 10B, and 10C. This is because a cover classifier is able to define well-behaved control temperature sequences from relatively few comfort events. In another example, the intelligent agent 404 can isolate and examine intervals of time with a constant TEB temperature segment of a specific minimum length. In some implementations, the system may only look for those segments that were system defined/driven as illustrated in the example shown in FIGS. 9A and 9B. The system intelligent agent 404 can also choose to modify an identified sub-interval of that interval in response to other observed conditions. In yet another example, proposed segments may be identified by the system prior to the beginning of an episode by the system intelligent agent 404 that (1) examines the TEB segments from the comfort map received from the profile library manager 402, (2) isolates those contiguous intervals of system/agent-driven TEB with a minimum length, and (3) modifies the TEB of the comfort map over those interval(s) as a proposed segment changes. In such 'minimum length' example, depending on the resolution, for example, a 30 minute or one hour segment 10% may be used as a threshold for segment identification.

In an implementation, the system intelligent agent 404 can use information derived by a regulation monitor from previous episodes to guide exploration. An example of this is to compare the measured temperature of the conditioned space against the corresponding control temperature sequence and only modify the comfort map over those intervals or sub-intervals for which the occupants actually "experienced" conditions from the previous episode conducive to exploration. The intelligent agent 404 can choose not to modify a comfort map region in which the occupants have had no known exposure to the conditions proposed by the control temperature sequence generator 414. This is described in further detail below.

A regulation monitor function can be used to compare the measured temperature of the temperature conditioned space 406, $T_{meas}(n)$ against the corresponding control temperature sequence, $T_{con}(n)$, on a time quantum by time quantum basis. In one implementation, regulation monitor 416 can assign one of at least three states to a regulation monitor state variable sequence $S_{reg}(n)$ in one to one correspondence with the time quanta of the episode. Example regulation monitor state values include "In Regulation", "Unregulated Passive", and "Unregulated Active". Three of the states above are assigned based on a comparison of measured temperature $T_{meas}(n)$ against the corresponding control temperature $T_{con}(n)$ to determine the regulation monitor state using rules described graphically in FIGS. 5B1 and 5B2.

FIGS. 5A, 5B1, and 5B2 discuss how the system incorporates regulation monitor data into the balancing of energy efficient operation with user comfort. The example flow diagram in FIG. 5A discusses aspects of how the system components/modules from FIG. 4 utilize regulation monitor data in step 504. Prior to initiation of a new episode, profile library manager 402 can provide a comfort map CM(o) to an exploration manager 410. CM(o) can represent the comfort map at the end of the previous episode for which the comfort map was used. The exploration manager 410 can isolate contiguous intervals of agent-driven TEB alone or in combination with using the regulation monitor state metadata to validate a proposed segment to determine if exploration is appropriate. In some implementations, while in the heating comfort mode, lowering the temperature of the TEB can be inhibited if the regulation monitor 416 is in the "Unregulated Passive" state, as implementing such a change could cause the temperature experienced by the occupants to be higher than that presented to the system as $T_{con}(n)$. To present an even lower temperature when the occupants have not had the opportunity to judge the present control temperature would be in error and could cause gross discomfort when external conditions permit temperature regulation. Similarly in the cooling comfort mode, raising the control temperature $T_{con}(n)$ when the regulation monitor function is in the "Unregulated Passive" state can be inhibited by the system intelligent agent 404, as the conditions in the temperature conditioned space 406 are already cooler than those proposed by the intelligent agent 404 via control temperature sequence generator 414.

FIGS. 5B1, and 5B2 shows a diagram illustrating aspects of the different regulation monitor 416 determination states and comfort mode intervals in some embodiments of the IUCEEMC. For example, in some implementations, for a system operating in the heating comfort mode at a specific time quantum, n, control temperature sequence generator 414 can provide a control temperature value $T_{con}(n)$. Many thermostatic temperature devices attempt to maintain the temperature within a specified range of the control temperature, $T_{con}(n)$. When the measured temperature $T_{meas}(n)$ between the range $T_{con}(n)-T_{L-} \leq T_{meas}(n) \leq T_{con}(n)+T_{L+}$, where TL− and TL+ are lower and upper additive limit values respectively, the conditioned space 406 can be determined to be "In Regulation" 554. For measured temperatures greater than $T_{con}(n)+T_{L+}$, the temperature conditioned space 406 can be determined to be in the "Unregulated Passive" state 556 when the system is in the heating comfort mode, as the temperature is warmer than the upper limit of temperature TL+ and the HVAC equipment 408 cannot remove heat in the heating comfort mode. For measured temperatures less than $T_{con}(n)-T_{L-}$, the temperature conditioned space 406 can be determined to be in "Unregulated Active" state 552, where the HVAC system 408 is actively adding heat to the temperature conditioned space 406 in anticipation that the temperature conditioned space 406 temperature will increase to within the temperature regulation limits of the thermostatic control device 418.

For a system operating in the cooling comfort mode at a specific time quantum, n, the system is said to be "In Regulation" 560 when the measured temperature $T_{meas}(n)$ between the range $T_{con}(n)-T_{L-} \leq T_{meas}(n) \leq T_{con}(n)+T_{L+}$, in the Unregulated Passive state 558 when the measured temperature is less than $T_{con}(n)-T_{L-}$, and in the Unregulated Active state 562 when the measured temperature is greater than $T_{con}(n)+T_{L+}$. Note that the values of TL+ and TL− can be different between the heating and cooling comfort modes.

In an alternative embodiment, the temperature of the TEB, TEB(n) can be provided to regulation monitor 416 instead of $T_{con}(n)$, in either the heating or cooling comfort mode.

The regulation monitor 416 can provide comfort map manager 412 with the state of the regulation $S_{reg}(n)$, on a time quantum by time quantum basis. Comfort map manager 412 can store this information as time-dependent metadata as part of or associated with the comfort map. Alternately, comfort map manager 412 can store the control temperature $T_{con}(n)$ and measured temperature $T_{meas}(n)$ and the regulation logic for FIGS. 5B1 and 5B2 can be incorporated into the exploration manager 410. Comfort map manager 412 can present the final comfort map CM(K) and corresponding comfort map data to profile library manager 402 for storage at the end of an episode where it can be retrieved and analyzed by exploration manager in a subsequent episode.

Exploration manager 410 can use the information from the regulation monitor comparison above, alone or along with other information, to validate proposed section/segment changes and determine certain intervals or sub-intervals are eligible for proposal as segment/sections to use for exploration and comfort map modification. For instance, there can be certain conditions under which operation in the "Unregulated Passive" state is expected. In the heating comfort mode, if the regulation monitor 416 is operating in the "In Regulation" state or "Unregulated Active" state and a control temperature is increased significantly, the regulation monitor state can transition to the "Unregulated Passive" state until enough heat is lost by temperature conditioned space 406 to cause the measured temperature to decrease sufficiently that the system can again regulate. If the control temperature sequence $T_{con}(n)$ is also stored, the intelligent agent 404 can determine that operation in the "Unregulated Passive" state is due to the decrease in control temperature and therefore expected over a period of time, and can choose to modify the regulation monitor state of a time quantum previously determined to be "Unregulated Passive" to a fourth regulation monitor state e.g., a "Transition" state.

Exploration manager 410 can apply various processing techniques alone or in combination with regulation monitor state and the type of TEB (agent-driven or occupant-driven). The system can then make decisions to permit exploration on a time-quantum by time-quantum basis. For instance, as a piece of meta-data, exploration manager 410 can, as internally used information, define a sequence of state validation variables referred to herein as "exploration state" variables, in one to one correspondence with the time quanta of the comfort map. In an example, the exploration state validation variables can take on two values, such as "Explorable", and "Not-explorable". In some implementations, exploration manager 410 can initialize the entire exploration state variable sequence to the state "Not-explorable". Exploration manager 410 can determine those intervals that are system defined/agent-driven from the thermal-equilibrium boundary of the initial comfort map, CM(o) and determine those intervals for which the thermal-equilibrium boundary is occupant-driven in the exploration state "Not-explorable". System defined/agent-driven intervals that are shorter than a certain minimum length (e.g., a 10% by unit/episode or less than 30 minutes), can also be ignored by exploration manager 410, and their state can remain "Not-explorable." In some implementations, the minimum length can be zero, by which the agent-driven interval may not be ignored. At the end of this process, intelligent agent 404 can designate those time quanta with exploration state "Explorable" as eligible for exploration or proposed segment/section modification.

A number of criteria can be used to determine which of the remaining time quanta are be marked "Explorable" and available for the exploration manager 410 to use as a viable, validated portion of the comfort map for proposed exploration. In some implementations, for example, the intelligent agent 404 can apply a validation window of a certain length $L_{win}$ (e.g., a four hour window) to the remaining agent-driven intervals of the comfort map. If a certain validation percentage of the time quanta of the interval or sub-interval under the window meet the regulation monitor state criteria of operating in the "Regulated" or "Unregulated-Active" state (and, optionally, the "Transition" state), each time quantum over that interval can be marked as "Explorable" in the corresponding exploration state variable sequence. In some implementations the percentage can be 50% and/or a similar percentage. For intervals shorter than $L_{win}$ but longer than the minimum agent-driven interval under consideration, the percentage criterion can be applied to the entire agent-driven interval. For intervals longer than the window length above, the criterion can be applied to a sliding window beginning at each time quantum, then the window can be moved one time quantum and the percentage criterion applied again, until the entire interval has been analyzed to determined to be either "Explorable" or "Not-explorable". Examining the resulting exploration state variable, the exploration manager 410 can then determine contiguous intervals marked "explorable", and determine on an interval by interval basis whether the corresponding interval of the comfort map can be modified.

In some implementations, the system intelligent agent via the exploration manager 410 can define proposed segments (e.g., by examining the TEB, using a cover classifier or other many means which are, on a time quantum by time quantum basis, partially occupant driven and partially agent driven. For example, where the cover classifier is employed by the control temperature sequence generator 414, exploration manager 410 can use the segments generated by the cover classifier as intervals, rather than the raw TEB as a guide to exploration. The cover classifier can generate a sequence of K segments (intervals), e.g., based on a comfort map as discussed in co-pending U.S. application Ser. No. 14/956,139, filed Dec. 1, 2015 and titled "Apparatuses, Methods and Systems for Comfort and Energy Efficiency Conformance in an HVAC System." An example of cover classifier segment exploration is illustrated in FIGS. 10A, 10B, and 10C and discussed in greater detail below.

In some implementations, the segments themselves can be labeled "agent-driven" or "occupant-driven" by the exploration manager 410 in several ways. In one implementation, any point or element on the thermal-equilibrium boundary covered by a segment is occupant-driven, the entire segment can be labeled occupant-driven (whether or not individual elements are "explorable" or "not-explorable"). In some implementations, when a segment is marked system/agent-driven then persistent changes may be applied to the comfort map, where applicable. If a segment is marked occupant-driven, then transient changes may be applied to the comfort map, where applicable. Examples of this are illustrated and discussed in greater detail below. Control temperature sequence generator 414 can therefore label each control temperature provided in the sequence $T_{con}(n)$ as occupant-driven or agent-driven in a 1-1 correspondence with the time quanta of the comfort map.

Figure 5A:
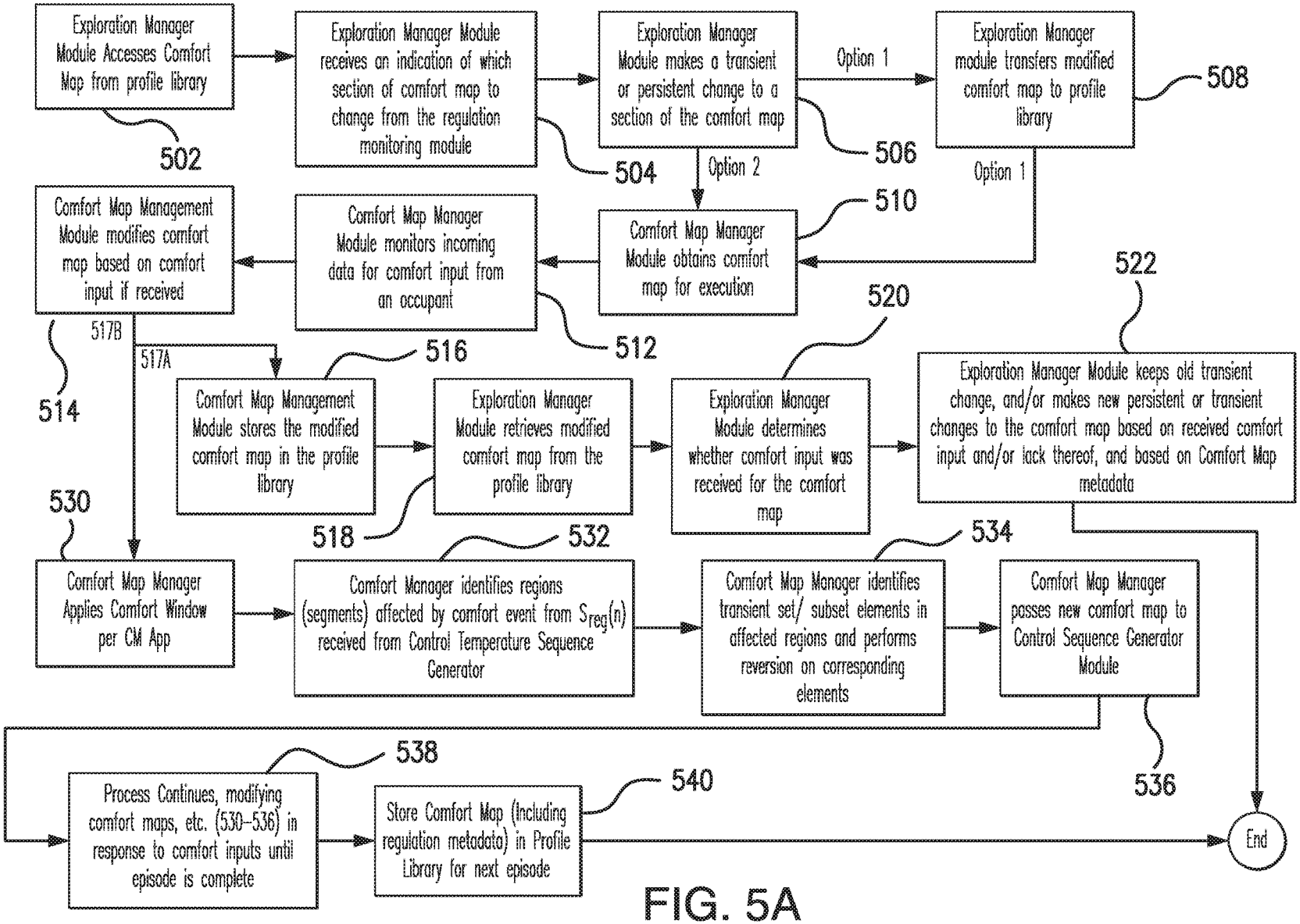
FIG. 5A shows a logic flow diagram illustrating a comfort agent system in some embodiments of the IUCEEMC.

FIG. 5A shows a logic flow diagram illustrating a system intelligent agent and related system modules according to some embodiments of the IUCEEMC. For the purposes of illustration and facilitating understanding the following example discuss modifying one portion of the comfort map during an episode. It is to be understood, that one or more portions of the comfort map may be modified during exploration in an episode. In some implementations, an exploration manager 410 can access or retrieve 502 a comfort map from profile library manager 402. The exploration manager 410 can receive 504 an indication of which time quanta of the comfort map are explorable and capable of being changed from metadata (as previously discussed) associated with and/or stored within the comfort map generated including information provided by the regulation monitoring 416 or comfort event data from the previous episode. The exploration manager 410 can then determine a proposed segment/section for modification. The exploration manager 410 can then make 506 a transient or persistent change to the section of the comfort map, and can store 508 the modified comfort map (and in some instances any necessary data to facilitate future reversion) in the profile library. Alternately, the exploration manager 410 can transfer the modified map with the proposed segment change(s) to the comfort map manager 412. For the active and/or subsequent episode(s), the comfort map management 412 can access the transferred comfort map or retrieve 510 the modified comfort map from the profile library manager 402, and can monitor 512 incoming data to determine whether comfort event input data has been provided by an occupant. If occupant comfort input has been provided, the comfort map management 412 can modify 514 the section of the comfort map corresponding to the comfort input if the proposed change was persistent or revert the change to previous comfort map states if necessary when the proposed change was transient. At the end of the episode, the comfort map management 412 can store 516 the modified comfort map in the profile library manager 402.

Depending on the implementation, the exploration manager 410 as decision branch 517A or the comfort map management 412 as decision branch 517B may execute reversion analysis. For decision branch 517A, during the next or subsequent episode(s) the modified comfort map is accessed/retrieved 518 from the profile library manager 402, and the exploration manager 410 can determine 520 whether comfort event data input was received for the comfort map from the comfort map metadata. The exploration manager 410 can then determine 522 to:

(1) update the map to transition old transient proposed segment changes and make such proposed segment changes persistent if a transient adoption threshold number of episodes (e.g., 3 episodes) have occurred without receiving comfort event data;

(2) maintain the status of proposed segment changes as transient changes; or (3) revert back to previous state comfort map data, thereby rejecting the proposed segment changes.

The system determines which of these three options to pursue based on the nature of received comfort event input from the occupant stored as comfort map metadata Preferably, determination 522 occurs at the end of the present episode prior to storage or prior to exploration comfort map portion determination in element 504.

For decision branch 517B, the comfort map manager 412 facilitates reversion in near-real time. When comfort event input is received, the comfort map manager immediately processes the comfort event data and applies an appropriate comfort event window, e.g., as detailed in U.S. application Ser. No. 14/956,082, filed Dec. 1, 2015 and titled "Interior Comfort HVAC User-Feedback Control System and Apparatus." The comfort map manager identifies 532 regions (segments) affected by the comfort even from $S_{seg}(k)$, (where k is the segment number e.g., associated with a cover comprising K segments–k=o, . . . , K–1 in some implementations), received from the Control Temperature Sequence Generator 414. $S_{seg}(k)$ is comfort map metadata that indicates the sequences of constant temperature as determined by the control temperature sequence generator 414 using the TEB, a cover classifier, or other means. Using these sequences, the comfort map manager identifies transient set/subset elements in the regions modified by the comfort window and performs reversion on the corresponding elements 534. Once the reversion is performed, the comfort map manager 412 passes the updated comfort map to the control temperature sequence generator 414 which, in turn develops an updated execution temperature trajectory and a new $S_{seg}(k)$ 536. This process continues until the end of the episode, repeating elements 530-536 until the episode is complete 538. At the end of an episode, the comfort map and corresponding comfort map metadata are stored in the profile library for the next episode.

FIGS. 6A-10C illustrate examples of how the IUCEEMC can work with comfort map data to facilitate exploration and reversion analysis, according to some embodiments.

Figure 6A:
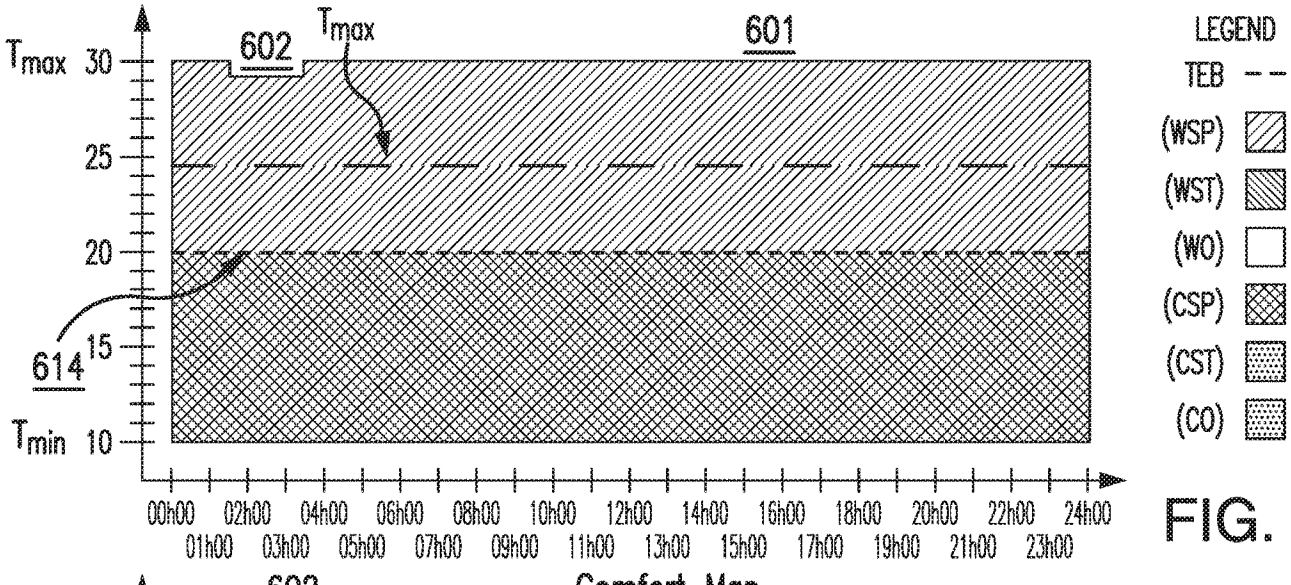
FIGS. 6A-6D show diagrams illustrating a comfort map and a control temperature sequence in some embodiments of the IUCEEMC.
Figure 6B:
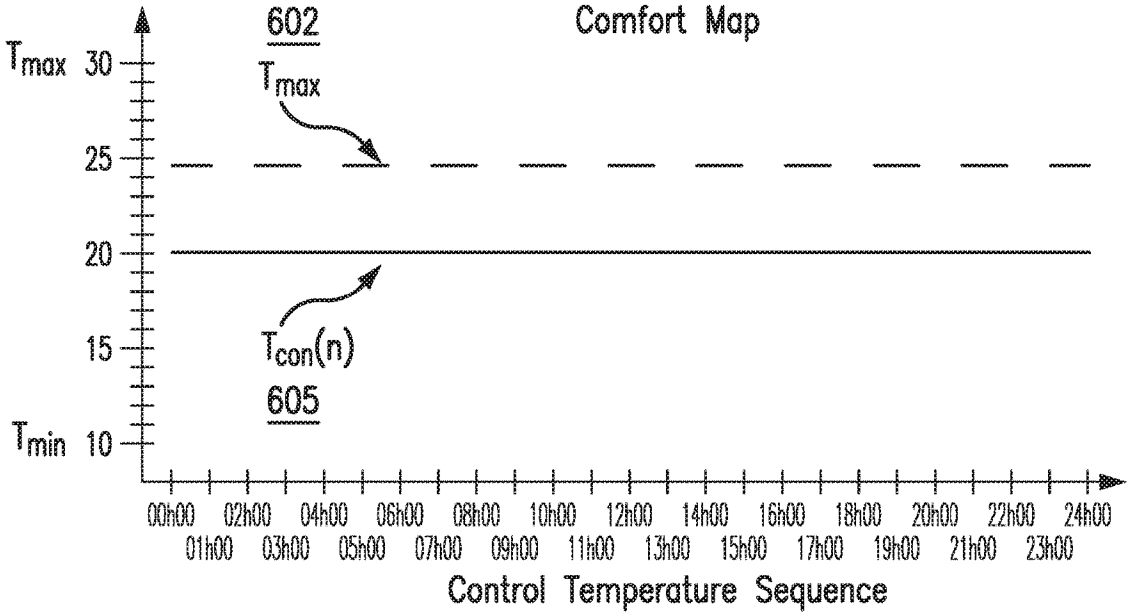

FIGS. 6A-6D illustrate aspects of persistent exploration. Referring to FIG. 6A, a comfort map 601 can be initialized such that the TEB 604 is a constant 20 C.° and the HVAC system is operating in the cooling comfort mode. Also included in FIG. 6A, the comfort map 601 can include a maximum temperature sequence $T_{max}(n)$ 602 in the cooling mode (or a $T_{min}(n)$ in the heating mode (not illustrated)) respectively, which can limit the range of exploration based on various considerations, such as the well-being of pets, plants and temperature sensitive equipment. This can serve as a system limit to cap system exploration. The temperature sequences $T_{max}(n)$ and $T_{min}(n)$ can be established during commissioning or may be updated dynamically by a system administrator. In the example given, a constant value (24.5 C.°) is shown as $T_{max}(n)$ 602, but other constant values or more complex time varying sequences $T_{max}(n)$ can be specified and $T_{min}(n)$ can be 10 C.° or 11 C.° for example When this comfort map 601 is provided to control temperature sequence generator 414, the resulting control temperature sequence $T_{con}(n)$ 605 is as shown in 6B, derived from the TEB 604. As the episode is played out, the resulting temperature in the temperature conditioned space 406 is regulated to that specified by $T_{con}(n)$ 605 per FIG. 6B. For this example, no comfort events were initiated during the episode. It can be assumed from this lack of occupant feedback that at any time quantum either 1) the temperature conditioned space 406 was unoccupied during the episode and there was little sensitivity to temperature; or 2) the temperature conditioned space 406 was occupied, but the constant 20 C.° caused no discomfort among the occupants.

Figure 6C:
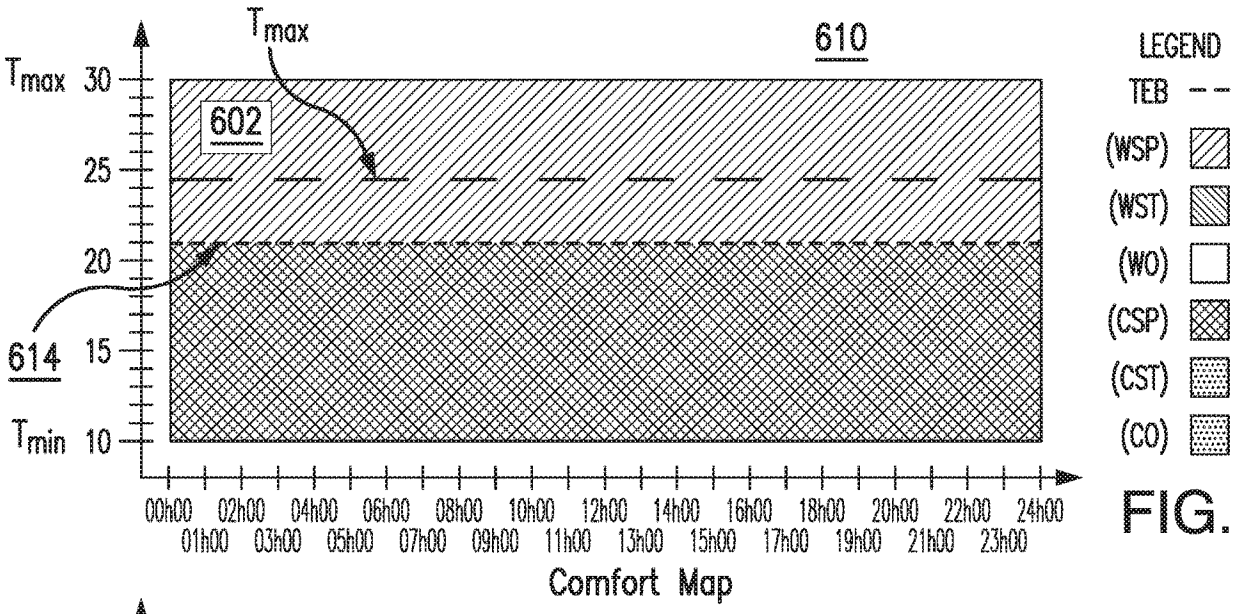
Figure 6D:
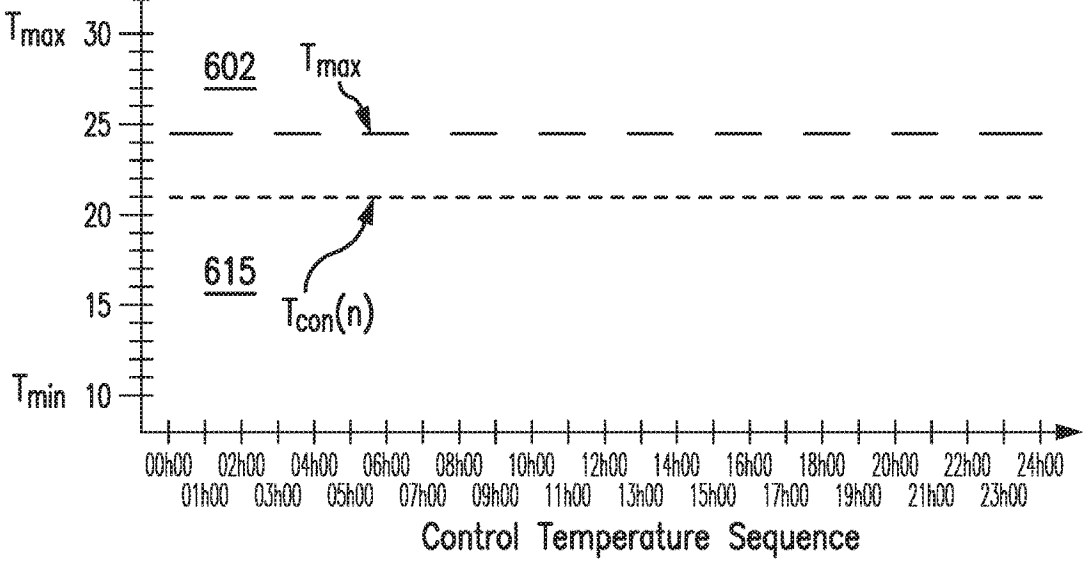

Accordingly, facilitating exploration by raising the temperature while the system is operating in the cooling comfort mode may achieve a lower operational energy, without impacting user comfort. Exploration manager 410 can propose that the occupants would be equally comfortable at a temperature of 21 C.°. If validated, the exploration management 410 can change the set/subset membership of all the elements in the comfort map 601 of FIG. 6A to modify presently marked subjectively warm (or {W}) elements between the temperatures of 20 C.° and 21 C.° to subjectively cool (or {C}) elements as shown in FIG. 6C prior to beginning of the subsequent episode as described previously. This moves the thermal equilibrium boundary 614 in FIG. 6C in the example case from 20 C.° to 21 C.° as shown. When this updated comfort map 610 is presented to control temperature sequence generator 414 the resulting control temperature sequence 615 of 21 C.° is shown in FIG. 6D, as derived from the updated TEB. Although it is not illustrated, if an occupant were uncomfortable and provided user comfort feedback data as a comfort event, the comfort map would be modified, e.g., as detailed in U.S. application Ser. No. 14/956,082, filed Dec. 1, 2015 and titled "Interior Comfort HVAC User-Feedback Control System and Apparatus."

Figure 7A:
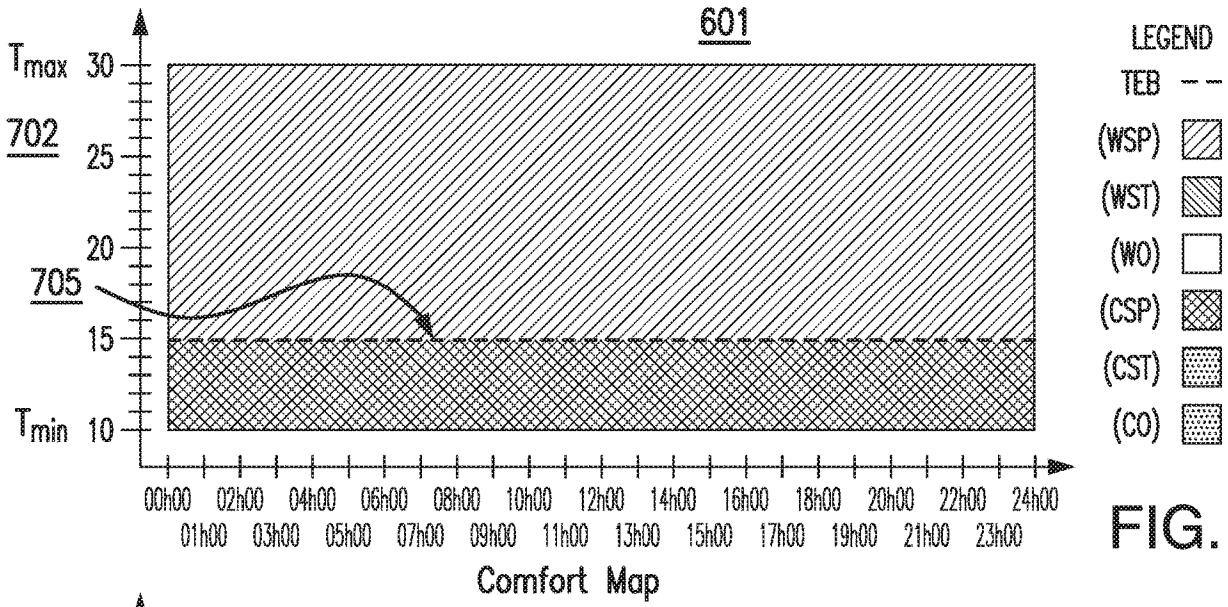
FIGS. 7A-7B show diagrams illustrating a comfort map and a control temperature sequence in some embodiments of the IUCEEMC.
Figure 7B:
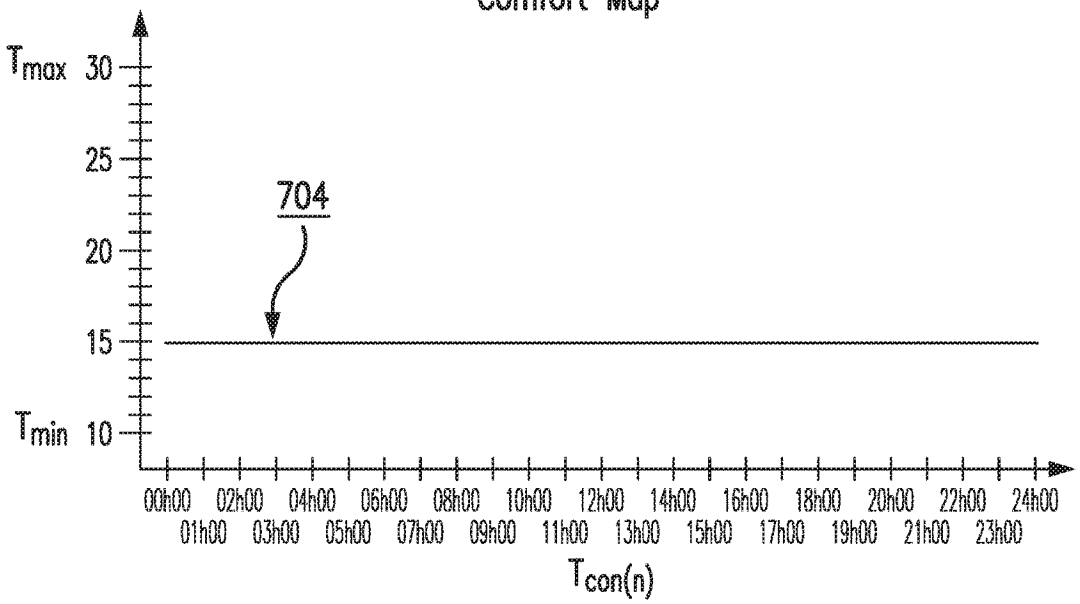

FIGS. 7A-9B show diagrams illustrating aspects of exploration with transient modifications of a comfort map and subsequent reversion when a comfort event is received and processed by the system. FIG. 7A illustrates an initial comfort map 702 that will be used to discuss these aspects as a heating comfort mode of operation. FIG. 7A shows a comfort map initialized such that a thermal equilibrium boundary 705 of 15 C.°. The region defined as {W} has been given membership in the subset {WSP}, while the region defined as {C} has been assigned membership in the subset {CSP}, indicating that there is no attempt made to recover previous membership in response to a comfort event.

When this comfort map 702 is provided to control temperature sequence generator 414, the resulting control temperature sequence $T_{con}$(n) 704 is as shown in 7B, derived from the TEB. As the episode is played out, the resulting temperature in the temperature conditioned space 406 is regulated to that specified by $T_{con}$(n) 704 per FIG. 7B.

Figure 8A:
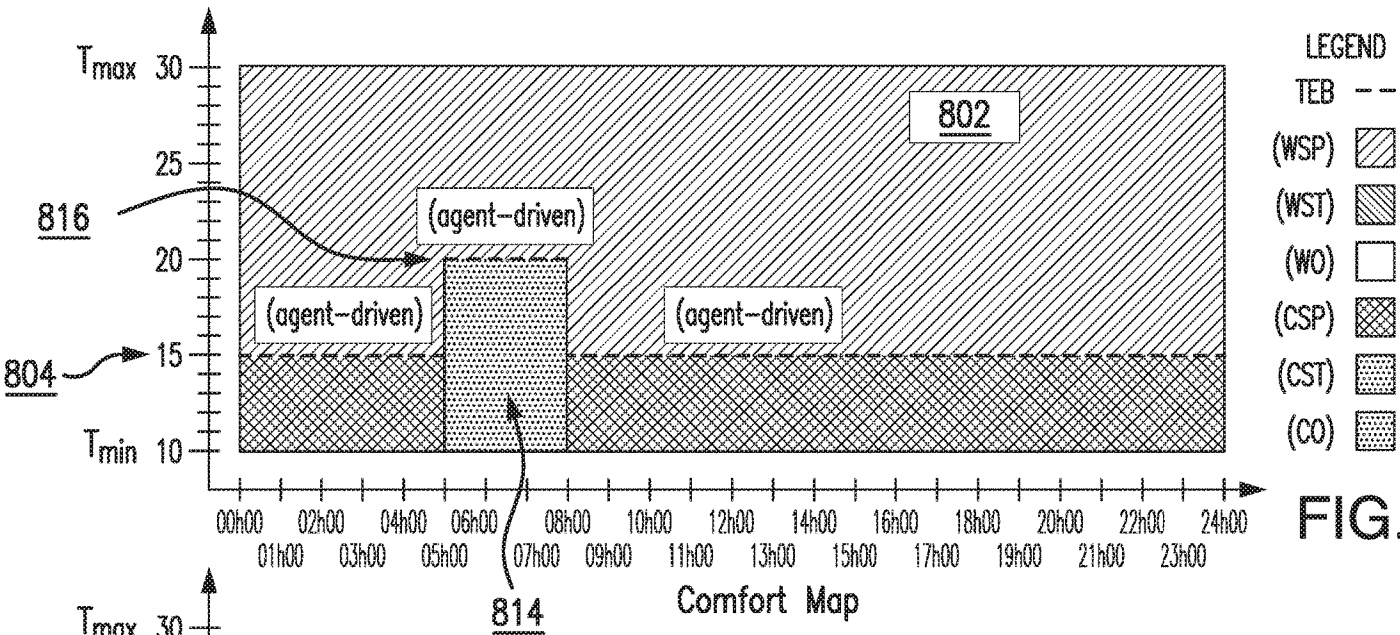
FIGS. 8A-8*b* show diagrams illustrating modifying a comfort map interval in some embodiments of the IUCEEMC.

FIG. 8A introduces a comfort event 814 as processed by the system and applied to the comfort map 702 resulting in the updated comfort map 802 illustrated in FIG. 8A. Suppose, that the control temperature sequence 705 is presented to thermostatic control device 418, which executes the sequence until 06 h00, at which time, an occupant issues a plus comfort event 814, and that this is the only comfort event issued during the episode. For this example, the comfort reference point is 06 h00, 15 C.°. Furthermore, the comfort event window parameters are:

$\Delta T_p$=5 C.°

$\Delta t_p^+$=120 minutes and $\Delta t_p^-$=60 minutes

Figure 8B:
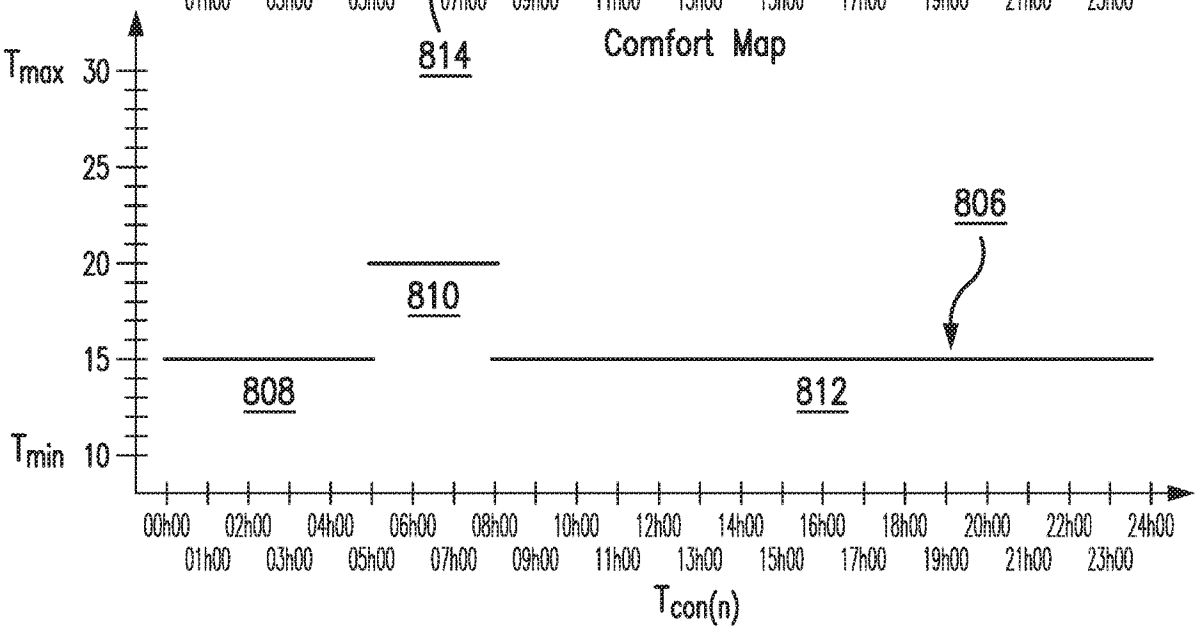

The resulting updated comfort map 802 is shown with proper subsets, along with updated TEB 804 in FIG. 8A and the control temperature sequence 806 in FIG. 8B generated by control temperature sequence generator 414 in response to processing this updated comfort map 802 (for the instant episode the control temperature sequence 806 is updated at of the time of the comfort event). Note that the region defined by the plus comfort window is assigned membership in the set {CO}. Accordingly, areas of the TEB 804 in FIG. 8A are now designated as occupant-driven 816.

The exploration manager 410 can identify the region of the comfort map 802 that is occupant driven 816 in FIG. 8A and propose transient exploration. The comfort map 802 can be modified in a temporary manner as transient proposed segment/section modifications by analyzing the set/subset element membership to achieve this. In the example, element set/subset membership modification leads to a shift in the TEB 804 to the updated TEB 904 shown in updated comfort map FIG. 9A1.

In FIGS. 8A and 8B, using the subsets described above, the intelligent agent 404 can propose the hypothesis that the temperature of the TEB 816 of interval segment 812 can be decreased by 2 C.°. For illustrative purposes, no other modifications to the comfort map 802 are proposed. Exploration manager 410 can affect this decrease in temperature of the section 816 of FIG. 8A TEB 806 by changing membership of all the elements in the comfort map 802 presently assigned to the set {CO} between the temperatures of 20 C.° and 18 C.° to the set {WST} in the comfort map corresponding to portion as shown as 910 in FIG. 9A1.

After the exploration manager 410 identifies and modifies the appropriate comfort map portion, the updated comfort map 902 is shown as with updated TEB 904 in FIG. 9A1. When this updated comfort map 902 from FIG. 9A1 is presented to comfort map manager 412 and subsequently to control temperature sequence generator 414, the resulting control temperature sequence $T_{con}$(n) 906 can be generated and executed as shown in FIG. 9B2. Note that the temperature over interval 916 is 18 C.°, which was formerly interval 810 from FIG. 8B as the comfort map portion to be tested for exploration.

Suppose that the comfort map portion modification is accepted by virtue of no comfort events during the proposed segment time interval for the episode described by FIG. 9A1. Prior to the beginning of the next episode, the intelligent agent 404 puts forth the hypothesis that the temperature of the TEB 904 corresponding to interval 916 in FIG. 9B1 can be reduced by an additional 5 C.°. Again, for illustrative purposes, assume that no other modifications to the comfort map 902 are proposed by the exploration manager 410. Exploration manager 410 can test this hypothesis by changing the membership of each element between the present 18 C.° and 13 C.° from {CO} to {WST}, as shown in 920 in FIG. 9B1. When this updated comfort map 902 from FIG. 9B1 is passed to comfort map manager 412 and subsequently to control temperature sequence generator 414, the resulting proposed control temperature sequence 910 for the episode is shown in FIG. 9B2.

This process can continue, with temperatures decreasing in the occupant-driven exploration interval of this example, episode over episode until at least one of 1) a plus comfort event is initiated by the occupants; or 2) the TEB of modified comfort map portion reaches a specified minimum temperature, $T_{min}$ (n) (not illustrated) on a time quantum by time quantum basis.

For the purposes of discussing aspects of transient reversion, in a subsequent episode using the comfort map 902 of FIG. 9B1, and the executing the execution temperature trajectory of FIG. 9B2, the system receives a plus comfort event at comfort event reference point (06 h00, 13 C.°). Even though the temperature at which this comfort event was issued is 2 C.° lower than when temperature from the initial comfort event, because the system reverts all occupant-driven transient changes back to the previous state (in the case the set/subset {CO} the comfort map 902 of FIG. 9B1 is reverted back to the comfort map 802 illustrated in FIG. 8A.

In the previous examples, the modified portion of the comfort map used for exploration was based on a contiguous temperature portion of the TEB (e.g., portion 810 in FIG. 8A). The following example discussed in FIGS. 10A-10C illustrates aspects of exploration using modified portions cover classifier segments developed by the exploration manager 410.

In the comfort map 1002 for this example, there have been two plus comfort events loom and 1003 that are illustrated in FIG. 10A1, as well corresponding TEB 1004. Control temperature sequence generator 414 applies a cover classifier to the comfort map 1002 of FIG. 10A1 resulting in the segments illustrated in FIG. 10A2 as a three segment cover 1009. FIG. 10A3 illustrates the execution temperature trajectory 1012 developed by the control temperature sequence generator 414 based on the comfort map 1002 from FIG. 10A1 and the provided cover classifier segments 1009 developed in FIG. 10A2. At the end of the episode, the comfort map manager stores the comfort map 1002 and corresponding metadata back into the profile library.

At the beginning of the next episode, the exploration manager 410 retrieves the stored comfort map 1002 applies a cover classifier and independently generating the segments 1009 illustrated in FIG. 10A2. The exploration manager 410 analyzes there segments and identifies segment 1010 as a proposed candidate for exploration as an occupant-driven as previously described. As an occupant-driven proposed exploration candidate segment 1010, the exploration manager 410 starts to develop proposed transient exploration after validating segment 1010.

In FIGS. 10A1 and 10A2, using the subsets described above, the exploration manager 410 can propose modifying the comfort map elements to explore a decremental shift of 2 C.°. In one implementation, since the exploration is seeking a cooler lower energy operational state, the system will achieves this exploration modification by identifying and modifying only elements that currently are associated with the cool set/subset and correspond with the proposed comfort map portion 1025. Exploration manager 410 can affect this decrease in temperature by changing membership of all the elements in the comfort map 1002 presently assigned to the set {CO} between the Temperatures of 20 C.° and 18 C.° to the set {WST} in the updated comfort map 1052 in FIG. 10B1.

FIG. 10B2 illustrates the effect of changing the elements of the modified comfort map portion 1025 in this example, as well as the resulting cover segments 1035 develop by the control temperature sequence generator 414 applying a cover classifier to the updated comfort map 1052. The control temperature sequence generator 414 can then derive the resulting execution temperature trajectory 1062 that is shown in FIG. 10B3.

If the system receives a plus comfort event that corresponds with the time interval 1070 in FIG. 10B1 of a transient exploration modified portion, the system will facilitate reversion. More specifically, if a part of a comfort event window developed based on the received plus comfort event overlaps with any segment $S_{seg}(k)$ (from FIG. 4), the system reverts the current state of all {WST} elements in the portion of the comfort map defined by $S_{seg}(k)$. For this particular example, one of the segment in the series $S_{seg}(k)$ 1075 in FIG. 10B1 corresponds identically to the exploration portion 1070 of the comfort map 1052 as segment 1010 from FIG. 10A2. Accordingly, the exploration portion of the comfort map corresponding to the segment 1010 results in the comfort map illustrated in FIG. 10A1.

Figure 11:
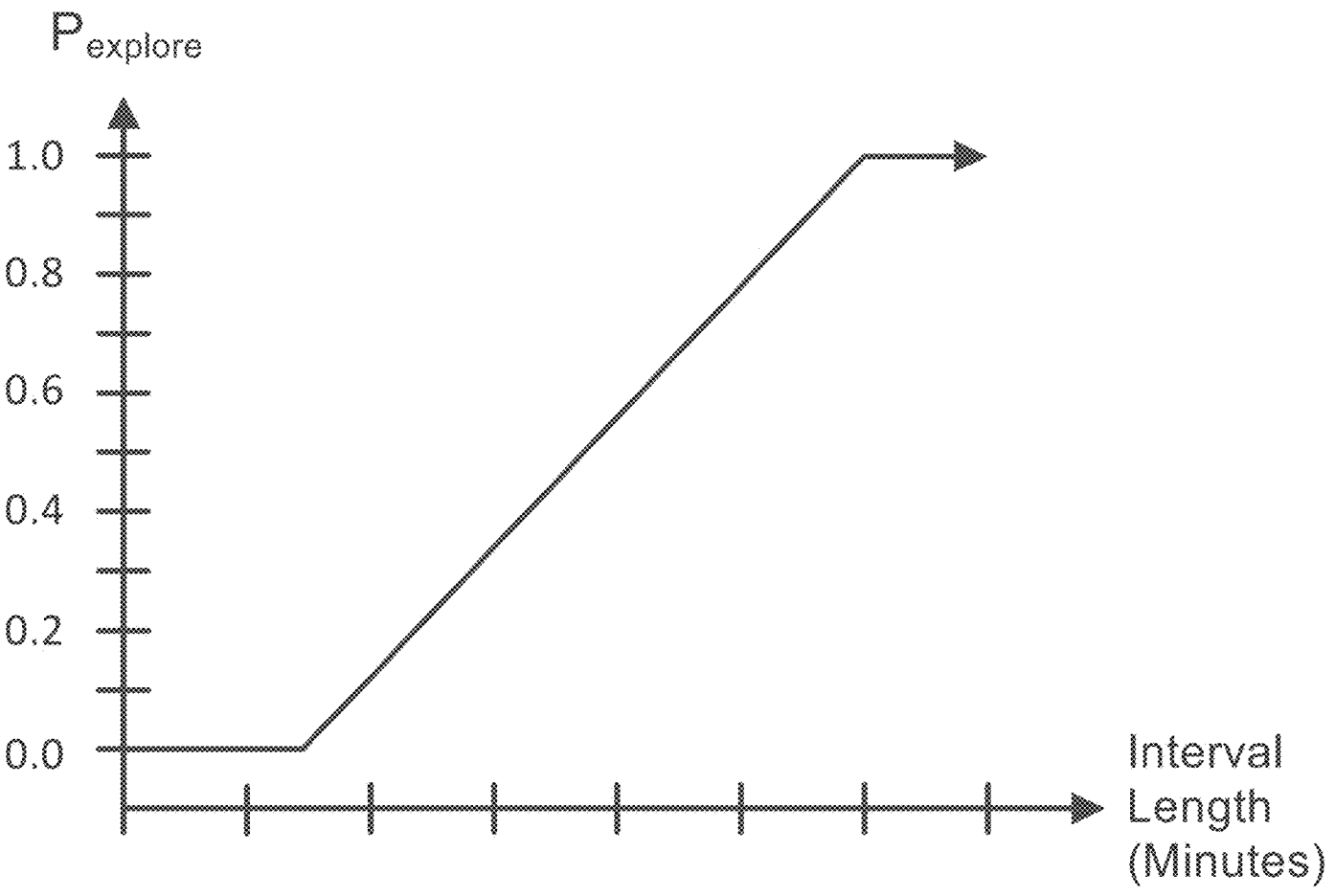
FIG. 11 shows a diagram illustrating applying/mapping exploration probability to comfort map interval lengths in some embodiments of the IUCEEMC.

FIG. 11 shows a diagram illustrating mapping exploration probability to comfort map interval lengths in some embodiments of the IUCEEMC. For example, 22 in some implementations, the probability of making a change to an interval marked "Explorable" by exploration manager 410 prior to initiation of an episode, can be a function of the agent-driven interval length, the function shown in FIG. 11 being an example function. It can be advantageous to aggressively move the TEB over long intervals marked "Explorable" where there has been no occupant interaction, to quickly determine occupant comfort, or that the temperature conditioned space is unoccupied, versus shorter intervals where the objective can be to "fine tune" the comfort map.

Figure 12:
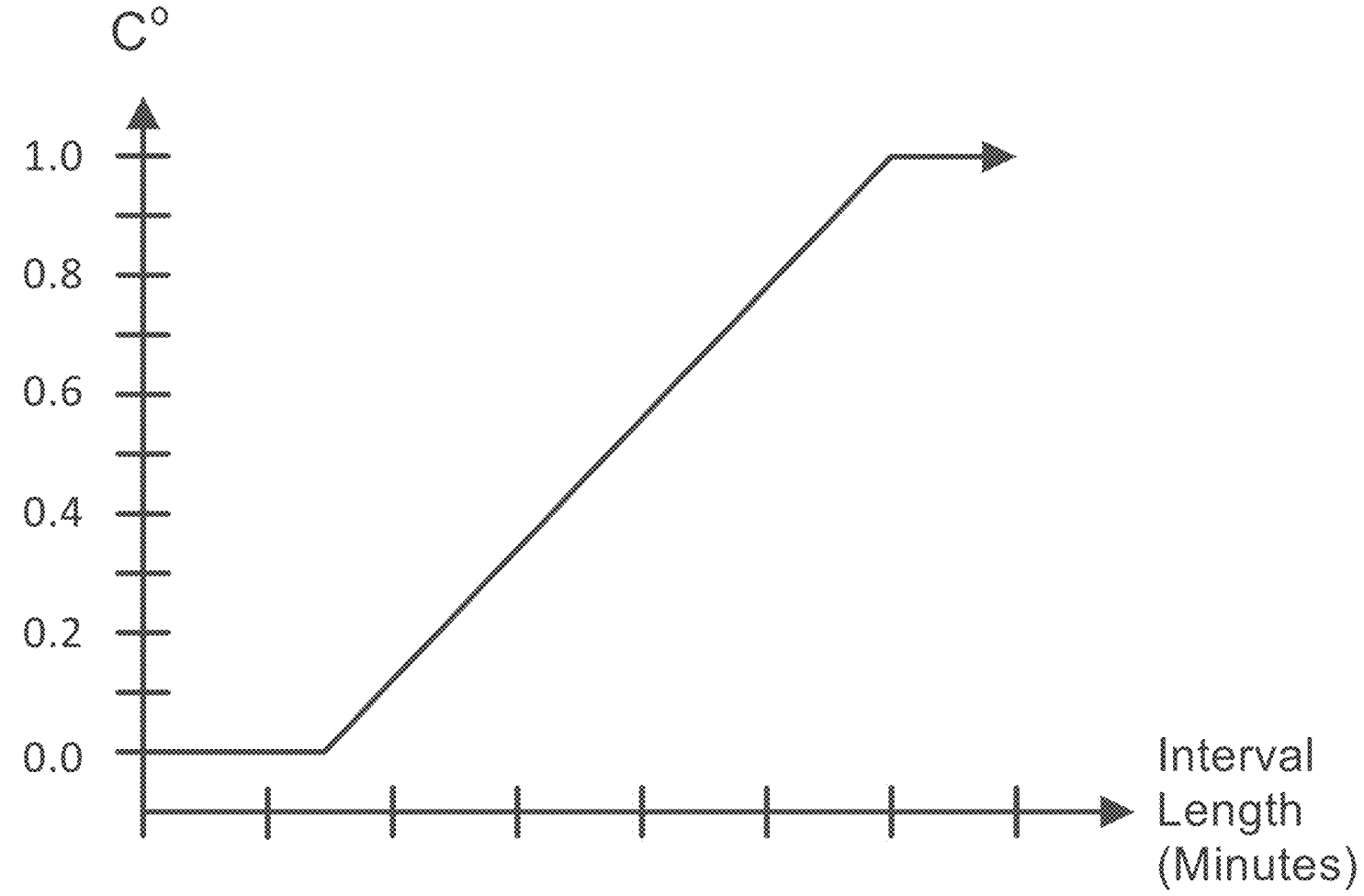
FIG. 12 shows a diagram illustrating applying/mapping temperatures to comfort map intervals in some embodiments of the IUCEEMC.

In some implementations, as shown in the function in FIG. 12, the magnitude of changes to a portion of a comfort map (e.g., by exploration manager 410) can be dependent upon the length of an interval of the comfort map. For example, for a long agent-driven portion, the exploration manager 410 can make more substantial changes in magnitude within the portion of the comfort map, than in shorter agent-driven portions to aggressively pursue identifying and shifting to lower HVAC operational energy states.

IUCEEMC Controller

FIG. 13 shows a block diagram illustrating embodiments of an IUCEEMC controller. In this embodiment, the IUCEEMC controller 1301 may serve to aggregate, process, store, search, serve, identify, instruct, generate, match, and/or facilitate interactions with a computer through resource management and energy efficiency technologies, and/or other related data.

Typically, users, which may be people and/or other systems, may engage information technology systems (e.g., computers) to facilitate information processing. In turn, computers employ processors to process information; such processors 1303 may be referred to as central processing units (CPU). One form of processor is referred to as a microprocessor. CPUs use communicative circuits to pass binary encoded signals acting as instructions to enable various operations. These instructions may be operational and/or data instructions containing and/or referencing other instructions and data in various processor accessible and operable areas of memory 1329 (e.g., registers, cache memory, random access memory, etc.). Such communicative instructions may be stored and/or transmitted in batches (e.g., batches of instructions) as programs and/or data components to facilitate desired operations. These stored instruction codes, e.g., programs, may engage the CPU circuit components and other motherboard and/or system components to perform desired operations. One type of program is a computer operating system, which, may be executed by CPU on a computer; the operating system enables and facilitates users to access and operate computer information technology and resources. Some resources that may be employed in information technology systems include: input and output mechanisms through which data may pass into and out of a computer; memory storage into which data may be saved; and processors by which information may be processed. These information technology systems may be used to collect data for later retrieval, analysis, and manipulation, which may be facilitated through a database program. These information technology systems provide interfaces that allow users to access and operate various system components.

In one embodiment, the IUCEEMC controller 1301 may be connected to and/or communicate with entities such as, but not limited to: one or more users from user input devices 1311; peripheral devices 1312; an optional cryptographic processor device 1328; and/or a communications network 1313.

Networks are commonly thought to comprise the interconnection and interoperation of clients, servers, and intermediary nodes in a graph topology. It should be noted that the term "server" as used throughout this application refers generally to a computer, other device, program, or combination thereof that processes and responds to the requests of remote users across a communications network. Servers serve their information to requesting "clients." The term "client" as used herein refers generally to a computer, program, other device, user and/or combination thereof that is capable of processing and making requests and obtaining and processing any responses from servers across a communications network. A computer, other device, program, or combination thereof that facilitates, processes information and requests, and/or furthers the passage of information from a source user to a destination user is commonly referred to as a "node." Networks are generally thought to facilitate the transfer of information from source points to destinations. A node specifically tasked with furthering the passage of information from a source to a destination is commonly called a "router." There are many forms of networks such as Local Area Networks (LANs), Pico networks, Wide Area Networks (WANs), Wireless Networks (WLANs), etc. For example, the Internet is generally accepted as being an interconnection of a multitude of networks whereby remote clients and servers may access and interoperate with one another.

The IUCEEMC controller 1301 may be based on computer systems that may comprise, but are not limited to, components such as: a computer systemization 1302 connected to memory 1329.

Computer Systemization

A computer systemization 1302 may comprise a clock 1330, central processing unit ("CPU(s)" and/or "processor(s)" (these terms are used interchangeable throughout the disclosure unless noted to the contrary)) 1303, a memory 1329 (e.g., a read only memory (ROM) 1306, a random access memory (RAM) 1305, etc.), and/or an interface bus 1307, and most frequently, although not necessarily, are all interconnected and/or communicating through a system bus 1304 on one or more (mother)board(s) 1302 having conductive and/or otherwise transportive circuit pathways through which instructions (e.g., binary encoded signals) may travel to effectuate communications, operations, storage, etc. The computer systemization may be connected to a power source 1386; e.g., optionally the power source may be internal. Optionally, a cryptographic processor 1326 and/or transceivers (e.g., ICs) 1374 may be connected to the system bus. In another embodiment, the cryptographic processor and/or transceivers may be connected as either internal and/or external peripheral devices 1312 via the interface bus I/O. In turn, the transceivers may be connected to antenna(s) 1375, thereby effectuating wireless transmission and reception of various communication and/or sensor protocols; for example the antenna(s) may connect to: a Texas Instruments WiLink WL1283 transceiver chip (e.g., providing 802.11n, Bluetooth 3.0, FM, global positioning system (GPS) (thereby allowing IUCEEMC controller to determine its location)); Broadcom BCM4329FKUBG transceiver chip (e.g., providing 802.11n, Bluetooth 2.1+EDR, FM, etc.); a Broadcom BCM4750IUB8 receiver chip (e.g., GPS); an Infineon Technologies X-Gold 618-PMB9800 (e.g., providing 2G/3G HSDPA/HSUPA communications); and/or the like. The system clock typically has a crystal oscillator and generates a base signal through the computer systemization's circuit pathways. The clock is typically coupled to the system bus and various clock multipliers that will increase or decrease the base operating frequency for other components interconnected in the computer systemization. The clock and various components in a computer systemization drive signals embodying information throughout the system. Such transmission and reception of instructions embodying information throughout a computer systemization may be commonly referred to as communications. These communicative instructions may further be transmitted, received, and the cause of return and/or reply communications beyond the instant computer systemization to: communications networks, input devices, other computer systemizations, peripheral devices, and/or the like. It should be understood that in alternative embodiments, any of the above components may be connected directly to one another, connected to the CPU, and/or organized in numerous variations employed as exemplified by various computer systems.

The CPU comprises at least one high-speed data processor adequate to execute program components for executing user and/or system-generated requests. Often, the processors themselves will incorporate various specialized processing units, such as, but not limited to: integrated system (bus) controllers, memory management control units, floating point units, and even specialized processing sub-units like graphics processing units, digital signal processing units, and/or the like. Additionally, processors may include internal fast access addressable memory, and be capable of mapping and addressing memory 1329 beyond the processor itself; internal memory may include, but is not limited to: fast registers, various levels of cache memory (e.g., level 1, 2, 3, etc.), RAM, etc. The processor may access this memory through the use of a memory address space that is accessible via instruction address, which the processor can construct and decode allowing it to access a circuit path to a specific memory address space having a memory state. The CPU may be a microprocessor such as: AMD's Athlon, Duron and/or Opteron; ARM's application, embedded and secure processors; IBM and/or Motorola's DragonBall and PowerPC; IBM's and Sony's Cell processor; Intel's Celeron, Core (2) Duo, Itanium, Pentium, Xeon, and/or XScale; and/or the like processor(s). The CPU interacts with memory through instruction passing through conductive and/or transportive conduits (e.g., (printed) electronic and/or optic circuits) to execute stored instructions (i.e., program code) according to conventional data processing techniques. Such instruction passing facilitates communication within the IUCEEMC controller and beyond through various interfaces. Should processing requirements dictate a greater amount speed and/or capacity, distributed processors (e.g., Distributed IUCEEMC), mainframe, multi-core, parallel, and/or super-computer architectures may similarly be employed. Alternatively, should deployment requirements dictate greater portability, smaller Personal Digital Assistants (PDAs) may be employed.

Depending on the particular implementation, features of the IUCEEMC may be achieved by implementing a microcontroller such as CAST's R8051XC2 microcontroller; Intel's MCS 51 (i.e., 8051 microcontroller); and/or the like. Also, to implement certain features of the IUCEEMC, some feature implementations may rely on embedded components, such as: Application-Specific Integrated Circuit ("ASIC"), Digital Signal Processing ("DSP"), Field Programmable Gate Array ("FPGA"), and/or the like embedded technology. For example, any of the IUCEEMC component collection (distributed or otherwise) and/or features may be implemented via the microprocessor and/or via embedded components; e.g., via ASIC, coprocessor, DSP, FPGA, and/or the like. Alternately, some implementations of the IUCEEMC may be implemented with embedded components that are configured and used to achieve a variety of features or signal processing.

Depending on the particular implementation, the embedded components may include software solutions, hardware solutions, and/or some combination of both hardware/software solutions. For example, IUCEEMC features discussed herein may be achieved through implementing FPGAs, which are a semiconductor devices containing programmable logic components called "logic blocks", and programmable interconnects, such as the high performance FPGA Virtex series and/or the low cost Spartan series manufactured by Xilinx. Logic blocks and interconnects can be programmed by the customer or designer, after the FPGA is manufactured, to implement any of the IUCEEMC features. A hierarchy of programmable interconnects allow logic blocks to be interconnected as needed by the IUCEEMC system designer/administrator, somewhat like a one-chip programmable breadboard. An FPGA's logic blocks can be programmed to perform the operation of basic logic gates such as AND, and XOR, or more complex combinational operators such as decoders or mathematical operations. In most FPGAs, the logic blocks also include memory elements, which may be circuit flip-flops or more complete blocks of memory. In some circumstances, the IUCEEMC may be developed on regular FPGAs and then migrated into a fixed version that more resembles ASIC implementations. Alternate or coordinating implementations may migrate IUCEEMC controller features to a final ASIC instead of or in addition to FPGAs. Depending on the implementation all of the aforementioned embedded components and microprocessors may be considered the "CPU" and/or "processor" for the IUCEEMC.

Power Source

The power source 1386 may be of any standard form for powering small electronic circuit board devices such as the following power cells: alkaline, lithium hydride, lithium ion, lithium polymer, nickel cadmium, solar cells, and/or the like. Other types of AC or DC power sources may be used as well. In the case of solar cells, in one embodiment, the case provides an aperture through which the solar cell may capture photonic energy. The power cell 1386 is connected to at least one of the interconnected subsequent components of the IUCEEMC thereby providing an electric current to all subsequent components. In one example, the power source 1386 is connected to the system bus component 1304. In an alternative embodiment, an outside power source 1386 is provided through a connection across the I/O 1308 interface. For example, a USB and/or IEEE 1394 connection carries both data and power across the connection and is therefore a suitable source of power.

Interface Adapters

Interface bus(ses) 1307 may accept, connect, and/or communicate to a number of interface adapters, conventionally although not necessarily in the form of adapter cards, such as but not limited to: input output interfaces (I/O) 1308, storage interfaces 1309, network interfaces 1310, and/or the like. Optionally, cryptographic processor interfaces 1327 similarly may be connected to the interface bus. The interface bus provides for the communications of interface adapters with one another as well as with other components of the computer systemization. Interface adapters are adapted for a compatible interface bus. Interface adapters conventionally connect to the interface bus via a slot architecture. Conventional slot architectures may be employed, such as, but not limited to: Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and/or the like.

Storage interfaces 1309 may accept, communicate, and/or connect to a number of storage devices such as, but not limited to: storage devices 1314, removable disc devices, and/or the like. Storage interfaces may employ connection protocols such as, but not limited to: (Ultra) (Serial) Advanced Technology Attachment (Packet Interface) ((Ultra) (Serial) ATA(PI)), (Enhanced) Integrated Drive Electronics ((E)IDE), Institute of Electrical and Electronics Engineers (IEEE) 1394, fiber channel, Small Computer Systems Interface (SCSI), Universal Serial Bus (USB), and/or the like.

Network interfaces 1310 may accept, communicate, and/or connect to a communications network 1313. Through a communications network 1313, the IUCEEMC controller is accessible through remote clients **1333*b* (e.g., computers with web browsers) by users 1333*a*. Network interfaces may employ connection protocols such as, but not limited to: direct connect, Ethernet (thick, thin, twisted pair 10/100/1000/10000 Base T, and/or the like), Token Ring, wireless connection such as IEEE 802.11a-x, and/or the like. Should processing requirements dictate a greater amount speed and/or capacity, distributed network controllers (e.g., Distributed IUCEEMC), architectures may similarly be employed to pool, load balance, and/or otherwise decrease/increase the communicative bandwidth required by the IUCEEMC controller. A communications network may be any one and/or the combination of the following: a direct interconnection; the Internet; Interplanetary Internet (e.g., Coherent File Distribution Protocol (CFDP), Space Communications Protocol Specifications (SCPS), etc.); a Local Area Network (LAN); a Metropolitan Area Network (MAN); an Operating Missions as Nodes on the Internet (OMNI); a secured custom connection; a Wide Area Network (WAN); a wireless network (e.g., employing protocols such as, but not limited to a cellular, WiFi, Wireless Application Protocol (WAP), I-mode, and/or the like); and/or the like. A network interface may be regarded as a specialized form of an input output interface. Further, multiple network interfaces 1310 may be used to engage with various communications network types 1313**. For example, multiple network interfaces may be employed to allow for the communication over broadcast, multicast, and/or unicast networks.

Input Output interfaces (I/O) 1308 may accept, communicate, and/or connect to user input devices 1311, peripheral devices 1312, cryptographic processor devices 1328, and/or the like. I/O may employ connection protocols such as, but not limited to: audio: analog, digital, monaural, RCA, stereo, and/or the like; data: Apple Desktop Bus (ADB), IEEE 1394a-b, serial, universal serial bus (USB); infrared; joystick; keyboard; midi; optical; PC AT; PS/2; parallel; radio;

video interface: Apple Desktop Connector (ADC), BNC, coaxial, component, composite, digital, Digital Visual Interface (DVI), high-definition multimedia interface (HDMI), RCA, RF antennae, S-Video, VGA, and/or the like; wireless transceivers: 802.11a/ac/b/g/n/x; Bluetooth; cellular (e.g., code division multiple access (CDMA), high speed packet access (HSPA(+)), high-speed downlink packet access (HSDPA), global system for mobile communications (GSM), long term evolution (LTE), WiMax, etc.); and/or the like. One typical output device may include a video display, which typically comprises a Cathode Ray Tube (CRT) or Liquid Crystal Display (LCD) based monitor with an interface (e.g., DVI circuitry and cable) that accepts signals from a video interface, may be used. The video interface composites information generated by a computer systemization and generates video signals based on the composited information in a video memory frame. Another output device is a television set, which accepts signals from a video interface. Typically, the video interface provides the composited video information through a video connection interface that accepts a video display interface (e.g., an RCA composite video connector accepting an RCA composite video cable; a DVI connector accepting a DVI display cable, etc.).

User input devices 1311 often are a type of peripheral device 512 (see below) and may include: card readers, dongles, finger print readers, gloves, graphics tablets, joysticks, keyboards, microphones, mouse (mice), remote controls, retina readers, touch screens (e.g., capacitive, resistive, etc.), trackballs, trackpads, sensors (e.g., accelerometers, ambient light, GPS, gyroscopes, proximity, etc.), styluses, and/or the like.

Peripheral devices 1312 may be connected and/or communicate to I/O and/or other facilities of the like such as network interfaces, storage interfaces, directly to the interface bus, system bus, the CPU, and/or the like. Peripheral devices may be external, internal and/or part of the IUCEEMC controller. Peripheral devices may include: antenna, audio devices (e.g., line-in, line-out, microphone input, speakers, etc.), cameras (e.g., still, video, webcam, etc.), dongles (e.g., for copy protection, ensuring secure transactions with a digital signature, and/or the like), external processors (for added capabilities; e.g., crypto devices 528), force-feedback devices (e.g., vibrating motors), network interfaces, printers, scanners, storage devices, transceivers (e.g., cellular, GPS, etc.), video devices (e.g., goggles, monitors, etc.), video sources, visors, and/or the like. Peripheral devices often include types of input devices (e.g., cameras).

It should be noted that although user input devices and peripheral devices may be employed, the IUCEEMC controller may be embodied as an embedded, dedicated, and/or monitor-less (i.e., headless) device, wherein access would be provided over a network interface connection.

Cryptographic units such as, but not limited to, microcontrollers, processors 1326, interfaces 1327, and/or devices 1328 may be attached, and/or communicate with the IUCEEMC controller. A MC68HC16 microcontroller, manufactured by Motorola Inc., may be used for and/or within cryptographic units. The MC68HC16 microcontroller utilizes a 16-bit multiply-and-accumulate instruction in the 16 MHz configuration and requires less than one second to perform a 512-bit RSA private key operation. Cryptographic units support the authentication of communications from interacting agents, as well as allowing for anonymous transactions. Cryptographic units may also be configured as part of the CPU. Equivalent microcontrollers and/or processors may also be used. Other commercially available specialized cryptographic processors include: Broadcom's CryptoNetX and other Security Processors; nCipher's nShield; SafeNet's Luna PCI (e.g., 7100) series; Semaphore Communications' 40 MHz Roadrunner 184; Sun's Cryptographic Accelerators (e.g., Accelerator 6000 PCIe Board, Accelerator 500 Daughtercard); Via Nano Processor (e.g., L2100, L2200, U2400) line, which is capable of performing 500+ MB/s of cryptographic instructions; VLSI Technology's 33 MHz 6868; and/or the like.

Memory

Generally, any mechanization and/or embodiment allowing a processor to affect the storage and/or retrieval of information is regarded as memory 1329. However, memory is a fungible technology and resource, thus, any number of memory embodiments may be employed in lieu of or in concert with one another. It is to be understood that the IUCEEMC controller and/or a computer systemization may employ various forms of memory 1329. For example, a computer systemization may be configured wherein the operation of on-chip CPU memory (e.g., registers), RAM, ROM, and any other storage devices are provided by a paper punch tape or paper punch card mechanism; however, such an embodiment would result in an extremely slow rate of operation. In a typical configuration, memory 1329 will include ROM 1306, RAM 1305, and a storage device 1314. A storage device 1314 may be any conventional computer system storage. Storage devices may include a drum; a (fixed and/or removable) magnetic disk drive; a magneto-optical drive; an optical drive (i.e., Blueray, CD ROM/RAM/Recordable (R)/ReWritable (RW), DVD R/RW, HD DVD R/RW etc.); an array of devices (e.g., Redundant Array of Independent Disks (RAID)); solid state memory devices (USB memory, solid state drives (SSD), etc.); other processor-readable storage mediums; and/or other devices of the like. Thus, a computer systemization generally requires and makes use of memory.

Component Collection

The memory 1329 may contain a collection of program and/or database components and/or data such as, but not limited to: operating system component(s) 1315 (operating system); information server component(s) 1316 (information server); user interface component(s) 1317 (user interface); Web browser component(s) 1318 (Web browser); database(s) 1319; mail server component(s) 1321; mail client component(s) 1322; cryptographic server component(s) 1320 (cryptographic server); the IUCEEMC component(s) 1335 (e.g., components 1341-1346, IVTMC component(s) as detailed in U.S. patent application Ser. No. 14/955,971, OCO component(s) as detailed in U.S. patent application Ser. No. 14/956,019, and/or UFCS/comfort map components as detailed in U.S. patent application Ser. No. 14/956,082); and/or the like (i.e., collectively a component collection). These components may be stored and accessed from the storage devices and/or from storage devices accessible through an interface bus. Although non-conventional program components such as those in the component collection, typically, are stored in a local storage device 1314, they may also be loaded and/or stored in memory such as: peripheral devices, RAM, remote storage facilities through a communications network, ROM, various forms of memory, and/or the like.

Operating System

The operating system component 1315 is an executable program component facilitating the operation of the IUCEEMC controller. Typically, the operating system facilitates access of I/O, network interfaces, peripheral devices, storage devices, and/or the like. The operating system may be a highly fault tolerant, scalable, and secure system such as: Apple Macintosh OS X (Server); AT&T Plan 9; Be OS; Unix and Unix-like system distributions (such as AT&T's UNIX; Berkley Software Distribution (BSD) variations such as FreeBSD, NetBSD, OpenBSD, and/or the like; Linux distributions such as Red Hat, Ubuntu, and/or the like); and/or the like operating systems. However, more limited and/or less secure operating systems also may be employed such as Apple Macintosh OS, IBM OS/2, Microsoft DOS, Microsoft Windows 2000/2003/3.1/95/98/CE/Millenium/NT/Vista/XP (Server), Palm OS, and/or the like. An operating system may communicate to and/or with other components in a component collection, including itself, and/or the like. Most frequently, the operating system communicates with other program components, user interfaces, and/or the like. For example, the operating system may contain, communicate, generate, obtain, and/or provide program component, system, user, and/or data communications, requests, and/or responses. The operating system, once executed by the CPU, may enable the interaction with communications networks, data, I/O, peripheral devices, program components, memory, user input devices, and/or the like. The operating system may provide communications protocols that allow the IUCEEMC controller to communicate with other entities through a communications network 1313. Various communication protocols may be used by the IUCEEMC controller as a subcarrier transport mechanism for interaction, such as, but not limited to: multicast, TCP/IP, UDP, unicast, and/or the like.

Information Server

An information server component 1316 is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective-) C (++), C# and/or .NET, Common Gateway Interface (CGI) scripts, dynamic (D) hypertext markup language (HTML), FLASH, Java, JavaScript, Practical Extraction Report Language (PERL), Hypertext Pre-Processor (PHP), pipes, Python, wireless application protocol (WAP), WebObjects, and/or the like. The information server may support secure communications protocols such as, but not limited to, File Transfer Protocol (FTP); HyperText Transfer Protocol (HTTP); Secure Hypertext Transfer Protocol (HTTPS), Secure Socket Layer (SSL), messaging protocols (e.g., America Online (AOL) Instant Messenger (AIM), Application Exchange (APEX), ICQ, Internet Relay Chat (IRC), Microsoft Network (MSN) Messenger Service, Presence and Instant Messaging Protocol (PRIM), Internet Engineering Task Force's (IETF's) Session Initiation Protocol (SIP), SIP for Instant Messaging and Presence Leveraging Extensions (SIMPLE), open XML-based Extensible Messaging and Presence Protocol (XMPP) (i.e., Jabber or Open Mobile Alliance's (OMA's) Instant Messaging and Presence Service (IMPS)), Yahoo! Instant Messenger Service, and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the IUCEEMC controller based on the remainder of the HTTP request. For example, a request such as http://123.124.125.126/myInformation.html might have the IP portion of the request "123.124.125.126" resolved by a DNS server to an information server at that IP address; that information server might in turn further parse the http request for the "/myInformation.html" portion of the request and resolve it to a location in memory containing the information "myInformation.html." Additionally, other information serving protocols may be employed across various ports, e.g., FTP communications across port 21, and/or the like. An information server may communicate to and/or with other components in a component collection, including itself, and/or facilities of the like. Most frequently, the information server communicates with the IUCEEMC database 1319, operating systems, other program components, user interfaces, Web browsers, and/or the like.

Access to the IUCEEMC database may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the IUCEEMC. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the IUCEEMC as a query. Upon generating query results from the query, the results are passed over the bridge mechanism, and may be parsed for formatting and generation of a new results Web page by the bridge mechanism. Such a new results Web page is then provided to the information server, which may supply it to the requesting Web browser.

Also, an information server may contain, communicate, generate, obtain, and/or provide program component, system, user, and/or data communications, requests, and/or responses.

User Interface

Computer interfaces in some respects are similar to automobile operation interfaces. Automobile operation interface elements such as steering wheels, gearshifts, and speedometers facilitate the access, operation, and display of automobile resources, and status. Computer interaction interface elements such as check boxes, cursors, menus, scrollers, and windows (collectively and commonly referred to as widgets) similarly facilitate the access, capabilities, operation, and display of data and computer hardware and operating system resources, and status. Operation interfaces are commonly called user interfaces. Graphical user interfaces (GUIs) such as the Apple Macintosh Operating System's Aqua, IBM's OS/2, Microsoft's Windows 2000/2003/3.1/95/98/CE/Millenium/NT/XP/Vista/7 (i.e., Aero), Unix's X-Windows (e.g., which may include additional Unix graphic interface libraries and layers such as K Desktop Environment (KDE), mythTV and GNU Network Object Model Environment (GNOME)), web interface libraries (e.g., ActiveX, AJAX, (D)HTML, FLASH, Java, JavaScript, etc. interface libraries such as, but not limited to, Dojo, jQuery(UI), MooTools, Prototype, script.aculo.us, SWFObject, Yahoo! User Interface, any of which may be used and) provide a baseline and means of accessing and displaying information graphically to users.

A user interface component 1317 is a stored program component that is executed by a CPU. The user interface may be a conventional graphic user interface as provided by, with, and/or atop operating systems and/or operating environments such as already discussed. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating systems, other program components, and/or the like. The user interface may contain, communicate, generate, obtain, and/or provide program component, system, user, and/or data communications, requests, and/or responses.

Web Browser

A Web browser component 1318 is a stored program component that is executed by a CPU. The Web browser may be a conventional hypertext viewing application such as Microsoft Internet Explorer or Netscape Navigator. Secure Web browsing may be supplied with 128 bit (or greater) encryption by way of HTTPS, SSL, and/or the like. Web browsers allowing for the execution of program components through facilities such as ActiveX, AJAX, (D)HTML, FLASH, Java, JavaScript, web browser plug-in APIs (e.g., FireFox, Safari Plug-in, and/or the like APIs), and/or the like. Web browsers and like information access tools may be integrated into PDAs, cellular telephones, and/or other mobile devices. A Web browser may communicate to and/or with other components in a component collection, including itself, and/or facilities of the like. Most frequently, the Web browser communicates with information servers, operating systems, integrated program components (e.g., plug-ins), and/or the like; e.g., it may contain, communicate, generate, obtain, and/or provide program component, system, user, and/or data communications, requests, and/or responses. Also, in place of a Web browser and information server, a combined application may be developed to perform similar operations of both. The combined application would similarly affect the obtaining and the provision of information to users, user agents, and/or the like from the IUCEEMC enabled nodes. The combined application may be nugatory on systems employing standard Web browsers.

Mail Server

A mail server component 1321 is a stored program component that is executed by a CPU 1303. The mail server may be a conventional Internet mail server such as, but not limited to sendmail, Microsoft Exchange, and/or the like. The mail server may allow for the execution of program components through facilities such as ASP, ActiveX, (ANSI) (Objective–) C (++), C# and/or .NET, CGI scripts, Java, JavaScript, PERL, PHP, pipes, Python, WebObjects, and/or the like. The mail server may support communications protocols such as, but not limited to: Internet message access protocol (IMAP), Messaging Application Programming Interface (MAPI)/Microsoft Exchange, post office protocol (POP3), simple mail transfer protocol (SMTP), and/or the like. The mail server can route, forward, and process incoming and outgoing mail messages that have been sent, relayed and/or otherwise traversing through and/or to the IUCEEMC.

Access to the IUCEEMC mail may be achieved through a number of APIs offered by the individual Web server components and/or the operating system.

Also, a mail server may contain, communicate, generate, obtain, and/or provide program component, system, user, and/or data communications, requests, information, and/or responses.

Mail Client

A mail client component 1322 is a stored program component that is executed by a CPU 1303. The mail client may be a conventional mail viewing application such as Apple Mail, Microsoft Entourage, Microsoft Outlook, Microsoft Outlook Express, Mozilla, Thunderbird, and/or the like. Mail clients may support a number of transfer protocols, such as: IMAP, Microsoft Exchange, POP3, SMTP, and/or the like. A mail client may communicate to and/or with other components in a component collection, including itself, and/or facilities of the like. Most frequently, the mail client communicates with mail servers, operating systems, other mail clients, and/or the like; e.g., it may contain, communicate, generate, obtain, and/or provide program component, system, user, and/or data communications, requests, information, and/or responses. Generally, the mail client provides a facility to compose and transmit electronic mail messages.

Cryptographic Server

A cryptographic server component 1320 is a stored program component that is executed by a CPU 1303, cryptographic processor 1326, cryptographic processor interface 1327, cryptographic processor device 1328, and/or the like. Cryptographic processor interfaces will allow for expedition of encryption and/or decryption requests by the cryptographic component; however, the cryptographic component, alternatively, may run on a conventional CPU. The cryptographic component allows for the encryption and/or decryption of provided data. The cryptographic component allows for both symmetric and asymmetric (e.g., Pretty Good Protection (PGP)) encryption and/or decryption. The cryptographic component may employ cryptographic techniques such as, but not limited to: digital certificates (e.g., X.509 authentication framework), digital signatures, dual signatures, enveloping, password access protection, public key management, and/or the like. The cryptographic component will facilitate numerous (encryption and/or decryption) security protocols such as, but not limited to: checksum, Data Encryption Standard (DES), Elliptical Curve Encryption (ECC), International Data Encryption Algorithm (IDEA), Message Digest 5 (MD5, which is a one way hash operation), passwords, Rivest Cipher (RC5), Rijndael, RSA (which is an Internet encryption and authentication system that uses an algorithm developed in 1977 by Ron Rivest, Adi Shamir, and Leonard Adleman), Secure Hash Algorithm (SHA), Secure Socket Layer (SSL), Secure Hypertext Transfer Protocol (HTTPS), and/or the like. Employing such encryption security protocols, the IUCEEMC may encrypt all incoming and/or outgoing communications and may serve as node within a virtual private network (VPN) with a wider communications network. The cryptographic component facilitates the process of "security authorization" whereby access to a resource is inhibited by a security protocol wherein the cryptographic component effects authorized access to the secured resource. In addition, the cryptographic component may provide unique identifiers of content, e.g., employing and MD5 hash to obtain a unique signature for an digital audio file. A cryptographic component may communicate to and/or with other components in a component collection, including itself, and/or facilities of the like. The cryptographic component supports encryption schemes allowing for the secure transmission of information across a communications network to enable the IUCEEMC component to engage in secure transactions if so desired. The cryptographic component facilitates the secure accessing of resources on the IUCEEMC and facilitates the access of secured resources on remote systems; i.e., it may act as a client and/or server of secured resources. Most frequently, the cryptographic component communicates with information servers, operating systems, other program components, and/or the like. The cryptographic component may contain, communicate, generate, obtain, and/or provide program component, system, user, and/or data communications, requests, and/or responses.

The IUCEEMC Database

The IUCEEMC database component 1319 may be embodied in a database and its stored data. The database is a stored program component, which is executed by the CPU; the stored program component portion configuring the CPU to process the stored data. The database may be a conventional, fault tolerant, relational, scalable, secure database such as Oracle or Sybase. Relational databases are an extension of a flat file. Relational databases consist of a series of related tables. The tables are interconnected via a key field. Use of the key field allows the combination of the tables by indexing against the key field; i.e., the key fields act as dimensional pivot points for combining information from various tables. Relationships generally identify links maintained between tables by matching primary keys. Primary keys represent fields that uniquely identify the rows of a table in a relational database. More precisely, they uniquely identify rows of a table on the "one" side of a one-to-many relationship.

Alternatively, the IUCEEMC database may be implemented using various standard data-structures, such as an array, hash, (linked) list, struct, structured text file (e.g., XML), table, and/or the like. Such data-structures may be stored in memory and/or in (structured) files. In another alternative, an object-oriented database may be used, such as Frontier, ObjectStore, Poet, Zope, and/or the like. Object databases can include a number of object collections that are grouped and/or linked together by common attributes; they may be related to other object collections by some common attributes. Object-oriented databases perform similarly to relational databases with the exception that objects are not just pieces of data but may have other types of capabilities encapsulated within a given object. If the IUCEEMC database is implemented as a data-structure, the use of the IUCEEMC database 1319 may be integrated into another component such as the IUCEEMC component 1335. Also, the database may be implemented as a mix of data structures, objects, and relational structures. Databases may be consolidated and/or distributed in countless variations through standard data processing techniques. Portions of databases, e.g., tables, may be exported and/or imported and thus decentralized and/or integrated.

In one embodiment, the database component 1319 includes several tables 1319*a-b*. A comfort map table 1319*a* includes fields such as, but not limited to: CM_ID, CM_name, CM_C, CM_W, CM_occupant, CM_metadata, CM_modification_log, and/or the like. The comfort map table may support and/or track multiple comfort maps on a IUCEEMC. An occupant table 1319*b* includes fields such as, but not limited to: occupant_ID, occupant_name, occupant_device, occupant_location, occupant_CMs, and/or the like. The occupant table may support and/or track multiple occupants on a IUCEEMC. In one embodiment, the IUCEEMC database may interact with other database systems. For example, employing a distributed database system, queries and data access by search IUCEEMC component may treat the combination of the IUCEEMC database, an integrated data security layer database as a single database entity.

In one embodiment, user programs may contain various user interface primitives, which may serve to update the IUCEEMC. Also, various accounts may require custom database tables depending upon the environments and the types of clients the IUCEEMC may need to serve. It should be noted that any unique fields may be designated as a key field throughout. In an alternative embodiment, these tables have been decentralized into their own databases and their respective database controllers (i.e., individual database controllers for each of the above tables). Employing standard data processing techniques, one may further distribute the databases over several computer systemizations and/or storage devices. Similarly, configurations of the decentralized database controllers may be varied by consolidating and/or distributing the various database components 1341-1346. The IUCEEMC may be configured to keep track of various settings, inputs, and parameters via database controllers.

The IUCEEMC database may communicate to and/or with other components in a component collection, including itself, and/or facilities of the like. Most frequently, the IUCEEMC database communicates with the IUCEEMC component, other program components, and/or the like. The database may contain, retain, and provide information regarding other nodes and data.

The IUCEEMCs

The IUCEEMC component 1335 is a stored program component that is executed by a CPU. In one embodiment, the IUCEEMC component incorporates any and/or all combinations of the aspects of the IUCEEMC that was discussed in the previous figures. As such, the IUCEEMC affects accessing, obtaining and the provision of information, services, transactions, and/or the like across various communications networks. The features and embodiments of the IUCEEMC discussed herein increase network efficiency by reducing data transfer requirements the use of more efficient data structures and mechanisms for their transfer and storage. As a consequence, more data may be transferred in less time, and latencies with regard to transactions, are also reduced. In many cases, such reduction in storage, transfer time, bandwidth requirements, latencies, etc., will reduce the capacity and structural infrastructure requirements to support the IUCEEMC's features and facilities, and in many cases reduce the costs, energy consumption/requirements, and extend the life of IUCEEMC's underlying infrastructure; this has the added benefit of making the IUCEEMC more reliable. Similarly, many of the features and mechanisms are designed to be easier for users to use and access, thereby broadening the audience that may enjoy/employ and exploit the feature sets of the IUCEEMC; such ease of use also helps to increase the reliability of the IUCEEMC. In addition, the feature sets include heightened security as noted via the Cryptographic components 1320, 1326, 1328 and throughout, making access to the features and data more reliable and secure The IUCEEMC transforms comfort maps and occupant comfort inputs via IUCEEMC profile library manager 1341, exploration manager 1342, comfort map manager 1343, regulation monitor 1344, control temperature sequence generator 1345, and comfort map modification 1346 components into comfort map and control temperature sequence outputs.

The IUCEEMC component enabling access of information between nodes may be developed by employing standard development tools and languages such as, but not limited to: Apache components, Assembly, ActiveX, binary executables, (ANSI) (Objective-) C (++), C# and/or .NET, database adapters, CGI scripts, Java, JavaScript, mapping tools, procedural and object oriented development tools, PERL, PHP, Python, shell scripts, SQL commands, web application server extensions, web development environments and libraries (e.g., Microsoft's ActiveX; Adobe AIR, FLEX & FLASH; AJAX; (D)HTML; Dojo, Java; JavaScript; jQuery(UI); MooTools; Prototype; script.aculo.us; Simple Object Access Protocol (SOAP); SWFObject; Yahoo! User Interface; and/or the like), WebObjects, and/or the like. In one embodiment, the IUCEEMC server employs a cryptographic server to encrypt and decrypt communications. The IUCEEMC component may communicate to and/or with other components in a component collection, including itself, and/or facilities of the like. Most frequently, the IUCEEMC component communicates with the IUCEEMC database, operating systems, other program components, and/or the like. The IUCEEMC may contain, communicate, generate, obtain, and/or provide program component, system, user, and/or data communications, requests, and/or responses.

Distributed IUCEEMCs

The structure and/or operation of any of the IUCEEMC node controller components may be combined, consolidated, and/or distributed in any number of ways to facilitate development and/or deployment. Similarly, the component collection may be combined in any number of ways to facilitate deployment and/or development. To accomplish this, one may integrate the components into a common code base or in a facility that can dynamically load the components on demand in an integrated fashion.

The component collection may be consolidated and/or distributed in countless variations through standard data processing and/or development techniques. Multiple instances of any one of the program components in the program component collection may be instantiated on a single node, and/or across numerous nodes to improve performance through load-balancing and/or data-processing techniques. Furthermore, single instances may also be distributed across multiple controllers and/or storage devices; e.g., databases. All program component instances and controllers working in concert may do so through standard data processing communication techniques.

The configuration of the IUCEEMC controller will depend on the context of system deployment. Factors such as, but not limited to, the budget, capacity, location, and/or use of the underlying hardware resources may affect deployment requirements and configuration. Regardless of if the configuration results in more consolidated and/or integrated program components, results in a more distributed series of program components, and/or results in some combination between a consolidated and distributed configuration, data may be communicated, obtained, and/or provided. Instances of components consolidated into a common code base from the program component collection may communicate, obtain, and/or provide data. This may be accomplished through intra-application data processing communication techniques such as, but not limited to: data referencing (e.g., pointers), internal messaging, object instance variable communication, shared memory space, variable passing, and/or the like.

If component collection components are discrete, separate, and/or external to one another, then communicating, obtaining, and/or providing data with and/or to other component components may be accomplished through inter-application data processing communication techniques such as, but not limited to: Application Program Interfaces (API) information passage; (distributed) Component Object Model ((D)COM), (Distributed) Object Linking and Embedding ((D)OLE), and/or the like), Common Object Request Broker Architecture (CORBA), Jini local and remote application program interfaces, JavaScript Object Notation (JSON), Remote Method Invocation (RMI), SOAP, process pipes, shared files, and/or the like. Messages sent between discrete component components for inter-application communication or within memory spaces of a singular component for intra-application communication may be facilitated through the creation and parsing of a grammar. A grammar may be developed by using development tools such as lex, yacc, XML, and/or the like, which allow for grammar generation and parsing capabilities, which in turn may form the basis of communication messages within and between components.

For example, a grammar may be arranged to recognize the tokens of an HTTP post command, e.g.:

w3c-post http:// . . . Value1 where Value1 is discerned as being a parameter because "http://" is part of the grammar syntax, and what follows is considered part of the post value. Similarly, with such a grammar, a variable "Value1" may be inserted into an "http://" post command and then sent. The grammar syntax itself may be presented as structured data that is interpreted and/or otherwise used to generate the parsing mechanism (e.g., a syntax description text file as processed by lex, yacc, etc.). Also, once the parsing mechanism is generated and/or instantiated, it itself may process and/or parse structured data such as, but not limited to: character (e.g., tab) delineated text, HTML, structured text streams, XML, and/or the like structured data. In another embodiment, inter-application data processing protocols themselves may have integrated and/or readily available parsers (e.g., JSON, SOAP, and/or like parsers) that may be employed to parse (e.g., communications) data. Further, the parsing grammar may be used beyond message parsing, but may also be used to parse: databases, data collections, data stores, structured data, and/or the like. Again, the desired configuration will depend upon the context, environment, and requirements of system deployment.

For example, in some implementations, the IUCEEMC controller may be executing a PHP script implementing a Secure Sockets Layer ("SSL") socket server via the information server, which listens to incoming communications on a server port to which a client may send data, e.g., data encoded in JSON format. Upon identifying an incoming communication, the PHP script may read the incoming message from the client device, parse the received JSON-encoded text data to extract information from the JSON-encoded text data into PHP script variables, and store the data (e.g., client identifying information, etc.) and/or extracted information in a relational database accessible using the Structured Query Language ("SQL"). An exemplary listing, written substantially in the form of PHP/SQL commands, to accept JSON-encoded input data from a client device via a SSL connection, parse the data to extract variables, and store the data to a database, is provided below:

```
<?PHP
header('Content-Type: text/plain');
// set ip address and port to listen to for incoming data
$address = '192.168.0.100';
$port = 255;
// create a server-side SSL socket, listen for/accept incoming
communication
$sock = socket_create (AF_INET, SOCK_STREAM, 0);
socket_bind($sock, $address, $port) or die('Could not bind to address');
socket_listen($sock);
$client = socket_accept($sock);
// read input data from client device in 1024 byte blocks until end of
message
do {
    $input = "";
    $input = socket_read($client, 1024);
    $data .= $input;
} while($input != "");
// parse data to extract variables
$obj = json_decode($data, true);
// store input data in a database
mysql_connect("201.408.185.132",$DBserver,$password); // access
database server
mysql_select("CLIENT_DB.SQL"); // select database to append
mysql_query("INSERT INTO UserTable (transmission)
VALUES ($data)"); // add data to UserTable table in a CLIENT database
mysql_close("CLIENT_DB.SQL"); // close connection to database
?>
```

Also, the following resources may be used to provide example embodiments regarding SOAP parser implementation:

http://www.xav.com/perl/site/lib/SOAP/Parser.html
http://publib.boulder.ibm.com/infocenter/tivihelp/v2r1/index.jsp?topic=/com.ibm.IBMDI.doc/referenceguide295.htm and other parser implementations:

http://publib.boulder.ibm.com/infocenter/tivihelp/v2r1/index.jsp?topic=/com.ibm.IBMDI.doc/referenceguide259.htm all of which are hereby expressly incorporated by reference.

To address various issues and advance the art, the entirety of this application for INTERIOR USER-COMFORT ENERGY EFFICIENCY MODELING AND CONTROL SYSTEMS AND APPARATUSES (including the Cover Page, Title, Headings, Field, Background, Summary, Brief Description of the Drawings, Detailed Description, Claims, Abstract, Figures, Appendices, and otherwise) shows, by way of illustration, various embodiments in which the claimed innovations may be practiced. The advantages and features of the application are of a representative sample of embodiments only, and are not exhaustive and/or exclusive. They are presented only to assist in understanding and teach the claimed principles. It should be understood that they are not representative of all claimed innovations. As such, certain aspects of the disclosure have not been discussed herein. That alternate embodiments may not have been presented for a specific portion of the innovations or that further undescribed alternate embodiments may be available for a portion is not to be considered a disclaimer of those alternate embodiments. It will be appreciated that many of those undescribed embodiments incorporate the same principles of the innovations and others are equivalent. Thus, it is to be understood that other embodiments may be utilized and functional, logical, operational, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the innovations, and inapplicable to others. In addition, the disclosure includes other innovations not presently claimed. Applicant reserves all rights in those presently unclaimed innovations including the right to claim such innovations, file additional applications, continuations, continuations in part, divisions, and/or the like thereof. As such, it should be understood that advantages, embodiments, examples, functional, features, logical, operational, organizational, structural, topological, and/or other aspects of the disclosure are not to be considered limitations on the disclosure as defined by the claims or limitations on equivalents to the claims. It is to be understood that, depending on the particular needs and/or characteristics of a IUCEEMC individual and/or enterprise user, database configuration and/or relational model, data type, data transmission and/or network framework, syntax structure, and/or the like, various embodiments of the IUCEEMC, may be implemented that enable a great deal of flexibility and customization. For example, aspects of the IUCEEMC may be adapted for management of energy efficiency outside of temperatures (e.g., light energy efficiency and/or the like). While various embodiments and discussions of the IUCEEMC have included energy efficiency and temperature management, however, it is to be understood that the embodiments described herein may be readily configured and/or customized for a wide variety of other applications and/or implementations.

What is claimed is:

1. A processor-implemented method of heating, ventilation, and air conditioning (HVAC) system control, the method comprising:

accessing comfort map data from a comfort map for an episode, the comfort map data including at least one episode state space, each element within the at least one episode state space having an assigned comfort characteristic variable setting, wherein the comfort map includes time, temperature and comfort characteristic data, and wherein each element within the at least one episode state space is assigned to a respective one of a warm set and a cool set, as well as a respective one of a system-defined subset or occupant-defined subset;

identifying a portion of the at least one episode state space as a proposed exploration segment candidate;

receiving comfort event data for time and temperature pair comfort event reference points corresponding to one or more elements of the identified portion of the at least one episode state space;

modifying an assignment of the one or more elements to the warm set or the cool set, based on the received comfort event data;

modifying, based on energy operational characteristics of the portion identified as an exploration segment candidate, the at least one comfort characteristic variable setting of at least one element of the identified portion of the at least one episode state space, wherein the comfort characteristic variable setting of the at least one element is modified to achieve (i) a warmer temperature when the HVAC system is in a cooling mode or (ii) a cooler temperature when the HVAC system is in a heating mode;

generating an execution temperature trajectory using the modified comfort characteristic variable setting; and executing the generated execution temperature trajectory on an HVAC system.

2. The method of claim 1, further comprising:

confirming whether the proposed exploration segment candidate is a viable portion for exploration by validating the comfort characteristic variable settings and/or memberships associated with the elements of the identified portion of the at least one episode state space.

3. The method of claim 2, wherein validation as a viable exploration segment candidate portion for exploration comprises:

accessing the portion of the at least one episode state space of the comfort map associated with the proposed exploration segment candidate;

analyzing a validation window of the accessed portion to determine a percentage of the window that meets regulation monitor state criteria;

marking the portion as explorable when a validation percentage threshold is met; and maintaining the portion as not-explorable when the validation percentage threshold is not met.

4. The method of claim 1, further comprising:

modifying the comfort characteristic variable setting of the at least one element of the identified portion of the at least one episode state space proposed as the exploration segment candidate to:

switch a warm and/or cool comfort characteristic variable setting and/or membership into the sets and/or subsets; and identify the elements of the at least one episode state space as system driven and/or as a persistent or transient change.

5. The method of claim 4, further comprising:

determining that the modified comfort characteristic variable setting indicates that the at least one element of the identified portion of the at least one episode state space proposed as the exploration segment candidate were modified as a transient change;

accessing the transient change modified element comfort characteristic data; and updating the comfort characteristic variable settings of the identified portion of the at least one episode state space to a previous state for the elements of the identified portion to facilitate reversion.

6. The method of claim 5, further comprising:

determining that the modified comfort characteristic variable setting indicates that the elements of the identified portion of the at least one episode state space were modified as a permanent change;

accessing comfort characteristic data for the elements of the identified portion of the at least one episode state space that fall within a comfort event window defined time and temperature pair comfort event reference points for the comfort map; and modifying comfort characteristic data settings for the elements of the identified portion of the at least one episode state space that fall within the comfort event window to shift a warm or cool setting.

7. The method of claim 4, wherein the identified portion of the at least one episode state space corresponds to a cover classifier developed segment.

8. The method of claim 4, wherein the identified portion of the at least one episode state space corresponds to a segment of a Thermal Equilibrium Boundary (TEB) for the comfort map, the TEB being used to divide the at least one episode state space of the comfort map into portions.

9. The method of claim 1, wherein a number of elements associated with the identified portion of the at least one episode state space are selected to facilitate conservative exploration and/or pushing exploration.

10. The method of claim 2, wherein the viable proposed exploration candidate is defined as having system driven and/or occupant driven comfort characteristic data.

11. The method of claim 1, wherein each episode state space of the at least one episode state space has an associated time and temperature range, and identifying a portion of the at least one episode state space as a proposed exploration segment candidate includes identifying a portion of the at least one episode state space as a proposed exploration segment candidate based on comfort characteristic data and/or comfort characteristic set membership.

12. A heating, ventilation, and air conditioning (HVAC) control apparatus, comprising:

a processor; and a memory disposed in communication with the processor and storing processor-issuable instructions to:

access comfort map data from a comfort map for an episode, the comfort map data including at least one episode state space, each element within the at least one episode state space having an assigned comfort characteristic variable setting, wherein the comfort map includes time, temperature and comfort characteristic data, and wherein each element within the at least one episode state space is assigned to a respective one of a warm set and a cool set, as well as a respective one of a system-defined subset or occupant-defined subset;

identify a portion of the at least one episode state space as a proposed candidate for exploration;

receive comfort event data for time and temperature pair comfort event reference points corresponding to one or more elements of the identified portion of the at least one episode state space;

modify an assignment of the one or more elements to the warm set or the cool set, based on the received comfort event data;

modify, based on energy operational characteristics of the portion identified as an exploration segment candidate, the at least one comfort characteristic variable setting of at least one element of the identified portion of the at least one episode state space, wherein the comfort characteristic variable setting of the at least one element is modified to achieve (i) a warmer temperature when the HVAC system is in a cooling mode or (ii) a cooler temperature when the HVAC system is in a heating mode;

develop an execution temperature trajectory using the modified comfort characteristic variable settings of the elements included in the identified portion of the at least one episode state space; and execute the developed execution temperature trajectory on an HVAC system.

13. The apparatus of claim 12, further comprising instructions to:

confirm if the proposed exploration candidate is a viable portion for exploration by validating the comfort characteristic variable settings associated with the elements included in the identified portion of the at least one episode state space, wherein the viable proposed exploration candidate is defined as having system driven and/or occupant driven comfort characteristic data.

14. The apparatus of claim 13, wherein validation as a viable portion for exploration comprises instructions to:

access the portion of the at least one episode state space of the comfort map associated with the proposed exploration candidate;

analyze a validation window of the accessed portion to determine a percentage of the window that meets regulation monitor state criteria;

mark the portion as explorable when a validation percentage threshold is met; and maintain the portion as not-explorable when the validation percentage threshold is not met.

15. The apparatus of claim 12, further comprising instructions to:

modify the comfort characteristic variable settings of the elements included in the identified portion of the at least one episode state space to:

switch a warm and/or cool comfort characteristic variable setting; and identify the elements included in the identified portion of the at least one episode state space as system driven and/or as a persistent or transient change.

16. The apparatus of claim 15, further comprising instructions to:

determine that the modified comfort characteristic variable setting indicates that the elements included in the identified portion of the at least one episode state space proposed as the candidate for exploration were modified as a transient change;

access the transient change modified element comfort characteristic data; and update the comfort characteristic variable settings of the elements included in the identified portion of the at least one episode state space to a previous state for elements to facilitate reversion.

17. The apparatus of claim 16, further comprising instructions to:

determine that the modified comfort characteristic variable setting indicates that the elements included in the identified portion of the at least one episode state space were modified as a permanent change;

access comfort characteristic data for the elements included in the identified portion of the at least one episode state space that fall within a comfort event window defined time and temperature pair comfort event reference points for the comfort map; and modify comfort characteristic data settings for the elements included in the identified portion of the at least one episode state space that fall within the comfort event window to shift a warm or cool setting.

18. The apparatus of claim 15, wherein the elements included in the identified portion of the at least one episode state space correspond to a cover classifier developed segment.

19. The apparatus of claim 15, wherein the elements included in the identified portion of the at least one episode state space correspond to a segment of a Thermal Equilibrium Boundary (TEB) for the comfort map, the TEB being used to divide the at least one episode state space of the comfort map into portions.

20. The apparatus of claim 12, wherein a number of elements included in the identified portion of the at least one episode state space are selected to facilitate conservative exploration and/or pushing exploration.

21. A non-transitory computer-readable medium that contains computer program code that, when executed by one or more computer processors, performs an operation for heating, ventilation, and air conditioning (HVAC) system control, the operation comprising:

accessing comfort map data from a comfort map for an episode, the comfort map data including at least one episode state space, each element within the at least one episode state space having an assigned comfort characteristic variable setting, wherein the comfort map includes time, temperature and comfort characteristic data, and wherein each element within the at least one episode state space is assigned to a respective one of a warm set and a cool set, as well as a respective one of a system-defined subset or occupant-defined subset;

identifying a portion of the at least one episode state space as a proposed exploration segment candidate;

receiving comfort event data for time and temperature pair comfort event reference points corresponding to one or more elements of the identified portion of the at least one episode state space;

modifying an assignment of the one or more elements to the warm set or the cool set, based on the received comfort event data;

modifying, based on energy operational characteristics of the portion identified as an exploration segment candidate, the at least one comfort characteristic variable setting of at least one element of the identified portion of the at least one episode state space, wherein the comfort characteristic variable setting of the at least one element is modified to achieve (i) a warmer temperature when the HVAC system is in a cooling mode or (ii) a cooler temperature when the HVAC system is in a heating mode;

generating an execution temperature trajectory using the modified comfort characteristic variable setting; and executing the generated execution temperature trajectory on an HVAC system.

* * * * *